US008306444B2

(12) United States Patent
Fukasawa

(10) Patent No.: US 8,306,444 B2
(45) Date of Patent: Nov. 6, 2012

(54) IMAGE FORMING APPARATUS

(75) Inventor: Hisashi Fukasawa, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 456 days.

(21) Appl. No.: 12/610,594

(22) Filed: Nov. 2, 2009

(65) Prior Publication Data

US 2010/0226669 A1 Sep. 9, 2010

(30) Foreign Application Priority Data

Mar. 9, 2009 (JP) ..... 2009-055257

(51) Int. Cl.
*G03G 15/00* (2006.01)

(52) U.S. Cl. ..... 399/49

(58) Field of Classification Search ..... 399/49, 399/316, 388
See application file for complete search history.

(56) References Cited

FOREIGN PATENT DOCUMENTS

| | | | |
|---|---|---|---|
| JP | 1-309082 | A | 12/1989 |
| JP | 6-281571 | A | 10/1994 |
| JP | 2002-31919 | A | 1/2002 |
| JP | 2004-85787 | A | 3/2004 |
| JP | 2006-003399 | A | 1/2006 |
| JP | 2006-53296 | A | 2/2006 |
| JP | 2007-033641 | A | 2/2007 |
| JP | 2007-333503 | A | 12/2007 |
| JP | 2009-47770 | A | 3/2009 |

OTHER PUBLICATIONS

Japanese Office Action issued on Mar. 1, 2011 in the corresponding Japanese Patent Application No. 2009-055257.

*Primary Examiner* — David Gray
*Assistant Examiner* — Erika J Villaluna
(74) *Attorney, Agent, or Firm* — Sughrue Mion, PLLC

(57) ABSTRACT

An image forming apparatus includes an image holding member, a visible image detecting unit, a shielding part, a conveying passage, and a medium contact part. The visible image detecting unit includes a detecting part and detects a visible image, and the detecting part is disposed to face the image holding member. The shielding part is supported to be movable between a shielding position where the detecting part is shielded, and a detection permitting position where the detecting part is exposed. The medium contact part is supported to be movable between an entry position where the medium contact part enters a conveying passage, and a medium contact position where the medium contact part comes into contact with a medium and recedes from the entry position. The image forming apparatus moves the shielding part while interlocking with the movement of the medium contact part.

7 Claims, 15 Drawing Sheets

Z
X
Y
(-X)
(-Y)
(-Z)
B
T1k
UK
Q4k
Pk
m1
Q11
m2
T2a
T2b
Q5
T2
S
L2'
12b
SN
SNa
CLk
11
12
12a
L1'
Q12
13
Gk
Rr

IMAGE FORMING APPARATUS

CROSS-REFERENCE TO RELATED APPLICATIONS

This application is based on and claims priority under 35 USC 119 from Japanese Patent Application No. 2009-055257 filed on Mar. 9, 2009.

BACKGROUND

1. Technical Field

The present invention relates to an image forming apparatus.

2. Related Art

A so-called electrophotographic image forming apparatus may be provided with a detecting member that detects the position, thickness, or the like of a visible image formed by a developer.

SUMMARY

According to an aspect of the invention, an image forming apparatus includes: an image holding member that holds a visible image formed by a developer; a visible image detecting unit that includes a detecting part and detects the visible image, the detecting part being disposed so as to face the image holding member; a shielding part supported so as to be movable between a shielding position where the shielding part enters between the detecting part and the image holding member and shields the detecting part, and a detection permitting position where the shielding part allows the detecting part to be exposed to the image holding member; a conveying passage along which a medium is conveyed, the visible image held on the image holding member being transferred to the medium; and a medium contact part supported so as to be movable between an entry position where the medium contact part enters the conveying passage, and a medium contact position where the medium contact part comes into contact with the medium passing through the conveying passage and recedes from the entry position. The shielding part is moved to the shielding position from the detection permitting position while interlocking with the movement of the medium contact part that is moved to the medium contact position from the entry position. The shielding part is moved to the detection permitting position from the shielding position while interlocking with the movement of the medium contact part that is moved to the entry position from the medium contact position.

BRIEF DESCRIPTION OF THE DRAWINGS

Exemplary embodiment(s) of the present invention will be described in detail based on the following figures, wherein:

FIG. 5A is a view illustrating that the recording sheet enters a sheet detection area, FIG. 5B is a view illustrating that the recording sheet is passing through the sheet detection area, and FIG. 5C is a view illustrating that the recording sheet has passed through the sheet detection area.

FIG. 6A is a view illustrating that the recording sheet enters the sheet detection area, FIG. 6B is a view illustrating that the recording sheet enters the sheet detection area and is passing through the sheet detection area, FIG. 6C is a view illustrating that a rear end of the recording sheet in a conveying direction passes through the sheet detection area, and FIG. 6D is a view illustrating that the recording sheet has passed through the sheet detection area.

FIG. 7A is a view illustrating that a recording sheet enters a sheet detection area, FIG. 7B is a view illustrating that the recording sheet is passing through the sheet detection area, and FIG. 7C is a view illustrating that the recording sheet has passed through the sheet detection area.

FIG. 9A is a view illustrating that a sheet-passing contact member is held at an entry position, a first seesaw arm is held at a visible image detecting unit-side stop position, and a second seesaw arm is held at a permission stop position. FIG. 9B is a view following FIG. 9A, and is a view illustrating that the sheet-passing contact member is moved to a medium contact position from the entry position. FIG. 9C is a view following FIG. 9B, and is a view illustrating that the first seesaw arm is moved to a conveying passage-side stop position. FIG. 9D is a view following FIG. 9C, and is a view illustrating that the first seesaw arm comes into contact with the second seesaw arm. FIG. 9E is a view following FIG. 9D, and is a view illustrating that the second seesaw arm is moved to a shielding stop position. FIG. 9F is a view following FIG. 9E, and is a view illustrating that the second seesaw arm has been moved to the shielding stop position.

FIG. 10A is a view illustrating that the sheet-passing contact member is held at the medium contact position, the first seesaw arm is held at the conveying passage-side stop position, and the second seesaw arm is held at the shielding stop position. FIG. 10B is a view following FIG. 10A, and is a view illustrating that the sheet-passing contact member is moved to the entry position from the medium contact position. FIG. 10C is a view following FIG. 10B, and is a view illustrating that the first seesaw arm is moved to the visible image detecting unit-side stop position. FIG. 10D is a view following FIG. 10C, and is a view illustrating that the first and second seesaw arms come into contact with each other. FIG. 10E is a view following FIG. 10D, and is a view illustrating that the second seesaw arm is moved to the permission stop position. FIG. 10F is a view following FIG. 10E, and is a view illustrating that the second seesaw arm is moved to the permission stop position.

DETAILED DESCRIPTION

Figure 1:
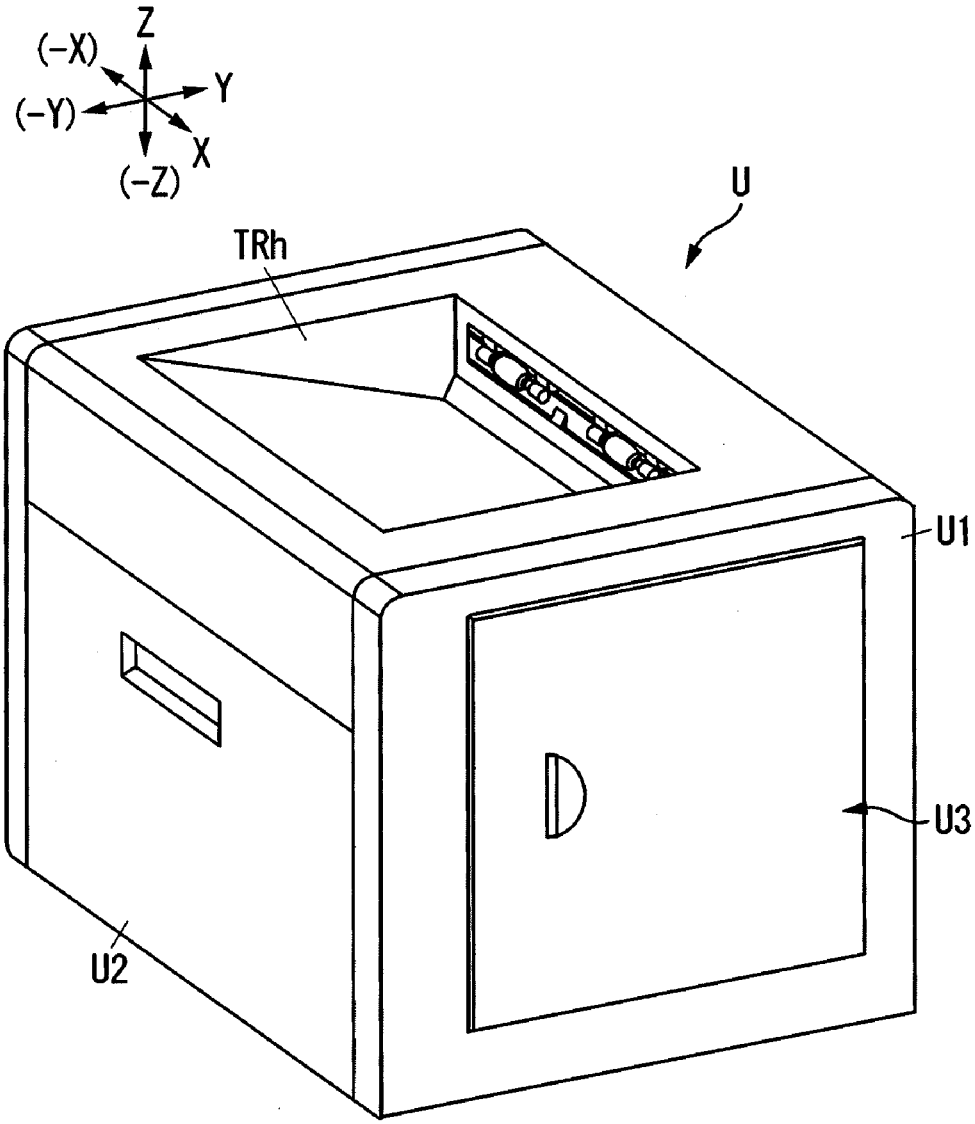
FIG. 1 is a perspective view of an image forming apparatus according to a first example of the invention.

Specific examples (hereinafter, referred to as examples) of an embodiment of the invention will be described below with reference to the drawings, but the invention is not limited to the following examples.

Meanwhile, in order to facilitate the understanding of the following descriptions, in the drawings, a front and rear direction is referred to as an X-axis direction, a left and right direction is referred to as a Y-axis direction, and a vertical direction is referred to as a Z-axis direction. Further, directions or sides indicated by arrows X, −X, Y, −Y, Z, and −Z are referred to as a front direction, a rear direction, a right direction, a left direction, an upper direction, and a lower direction, or a front side, a rear side, a right side, a left side, an upper side, and a lower side, respectively.

Furthermore, in the drawings, a mark where "●" exists in a "○" means an arrow that faces the front side of the plane of paper in the drawing from the rear side thereof, and a mark where "x" exists in a "○" means an arrow that faces the rear side of the plane of paper in the drawing from the front side thereof.

Meanwhile, members, which are not required for the description, are appropriately omitted in order to facilitate the understanding of the following description with reference to the drawings.

First Example

FIG. 1 is a perspective view of an image forming apparatus according to a first example of the invention.

Figure 2:
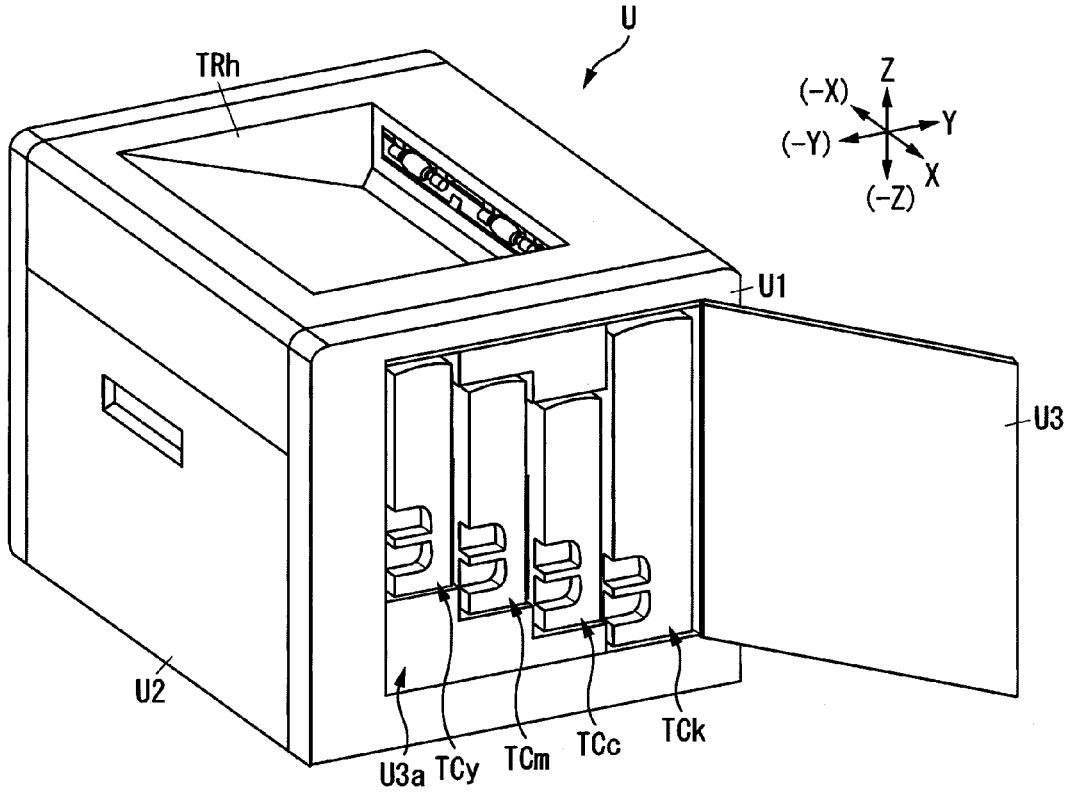
FIG. 2 is a perspective view of the image forming apparatus according to the first example of the invention, and is a perspective view showing that a front cover is opened.

FIG. 2 is a perspective view of the image forming apparatus according to the first example of the invention, and is a perspective view showing that a front cover is opened.

In FIG. 1, a printer U as an example of the image forming apparatus according to the first example of the invention includes an image forming apparatus body U1. A left cover U2 as an example of an opening/closing member for the replenishment of media, which is opened/closed during the replenishment of new media, is supported on the left surface of the image forming apparatus body U1 so as to be openable/closable about a lower end thereof. In FIGS. 1 and 2, a front cover U3 as an example of an opening/closing member for the replacement of a container is supported on the front surface of the image forming apparatus body U1 so as to be openable/closable about a right end thereof. The front cover is opened/closed during the replacement of toner cartridges TCy, TCm, TCc, and TCk as examples of replacement containers that supply new toner as an example of a new developer or collect waste toner as an example of a waste developer. A cartridge mounting portion U3*a* as an example of a container mounting portion, on which the toner cartridges TCy to TCk are detachably supported, is formed in the image forming apparatus body U1 inside the front cover U3. A discharge tray TRh as an example of a medium discharge part is provided on the upper surface of the image forming apparatus body U1.

Figure 3:
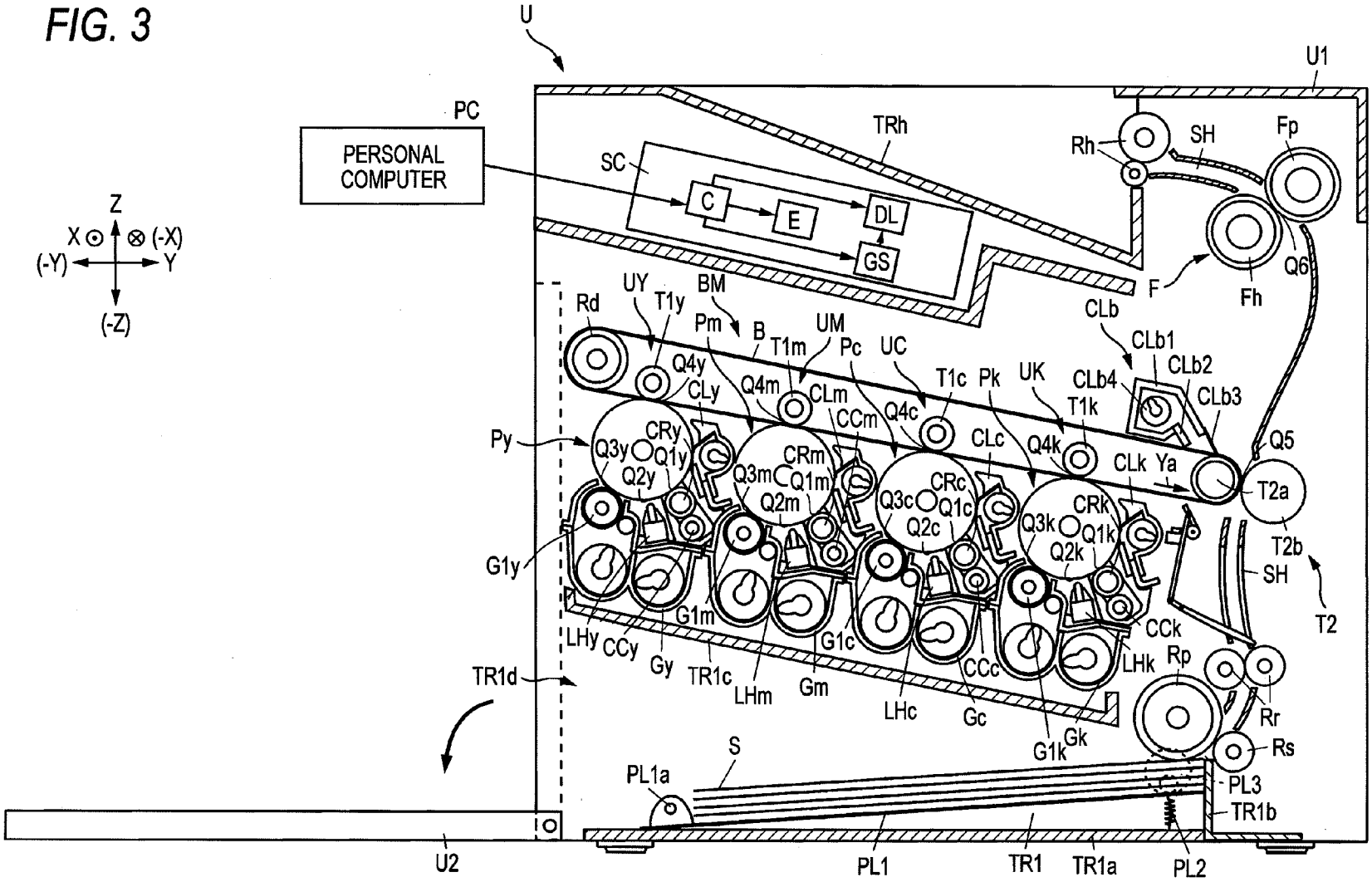
FIG. 3 is a view illustrating the entire image forming apparatus according to the first example of the invention.

FIG. 3 is a view illustrating the entire image forming apparatus according to the first example of the invention.

In FIGS. 1 and 3, the left cover U2 is movably supported between an open position shown by a solid line in FIG. 3 where a recording sheet S as an example of a medium can be inserted and a closed position that is shown by a broken line in FIG. 3 and shown in FIG. 1.

In FIG. 3, a control board SC on which various circuits or storage media are disposed are disposed below the discharge tray TRh at an upper portion of the printer U. A control unit C, an image processing unit GS, a latent image forming unit driving circuit DL, a power source circuit E as an example of a power-supply unit, and the like are provided on the control board SC. The control unit performs various kinds of control of the printer U. The actuation of each of the image processing unit, the latent image forming unit driving circuit, and the power source circuit is controlled by the control unit C. The power source circuit E applies voltages to charging rollers CRy, CRm, CRc, and CRk as examples of the following chargers, developing rollers G1*y*, G1*m*, G1*c*, and G1*k* as examples of developer holding bodies, primary transfer rollers T1*y*, T1*m*, T1*c*, and T1*k* as examples of first transfer devices, and the like.

The image processing unit GS converts the printing information, which is input from a personal computer PC or the like as an example of an external image information transmitting unit, into image information for forming latent images that correspond to yellow, magenta, cyan, and black images, that is, four-color (Y, M, C, and K) images. Then, the image processing unit outputs the image information to the latent image forming unit driving circuit DL at a predetermined time.

Meanwhile, if a document image is a one-color image, that is, a so-called monochromatic image, image information about only a black color is input to the latent image forming unit driving circuit DL.

The latent image forming unit driving circuit DL includes driving circuits (not shown) that correspond to the respective colors (Y, M, C, and K), and outputs signals, which correspond to the input image information, to LED heads LHy, LHm, LHc, and LHk as examples of latent image forming units that are disposed for the respective colors at a predetermined time.

In FIG. 3, visible image forming units UY, UM, UC, and UK, which form toner images as examples of visible images formed by the toner as examples of respective yellow, magenta, cyan, and black developers, are sequentially disposed at a middle lower portion of the image forming apparatus body U1 from a left upper portion toward a right lower portion. In FIG. 3, a visible image forming unit UK corresponding to a black color, that is, the K color includes a photoreceptor Pk as an example of a rotating first image holding member. The charging roller CRk that charges the surface of the photoreceptor Pk with electricity, the LED head LHk that forms an electrostatic latent image on the surface of the photoreceptor Pk, a developing unit Gk that develops the electrostatic latent image formed on the surface of the photoreceptor Pk, a photoreceptor cleaner CLk as an example of an image holding member cleaner that removes the toner remaining on the surface of the photoreceptor Pk, and the like are disposed around the photoreceptor Pk.

Each of the visible image forming units UY, UM, and UC corresponding to the other colors also has the same structure as the visible image forming unit UK corresponding to a black color.

The surfaces of the photoreceptors Py to Pk are uniformly charged with electricity by the charging rollers CRy to CRk in charging areas Q1*y*, Q1*m*, Q1*c*, and Q1*k* that face the charging rollers CRy to CRk. Then, the latent images are written on the surfaces of the photoreceptors by the LED heads LHy to LHk in the latent image forming areas Q2*y*, Q2*m*, Q2*c*, and Q2*k*. The written electrostatic latent images are developed as toner images in developing areas Q3*y*, Q3*m*, Q3*c*, and Q3*k* that face the developing units Gy to Gk. While being held on the photoreceptors Py to Pk, the developed toner images are conveyed to primary transfer areas Q4*y*, Q4*m*, Q4*c*, and Q4*k* as examples of first transfer areas coming into contact with an intermediate transfer belt B that serves as an example of a second image holding member and an intermediate transfer body. Primary transfer voltages of which the polarities are opposite to the charging polarities of the toner are applied to the primary transfer rollers T1*y* to T1*k*, which are disposed on the back side of the intermediate transfer belt B in the primary transfer areas Q4*y*, Q4*m*, Q4*c*, and Q4*k*, from the power source circuit E, which is controlled by the control unit C, at a predetermined time.

The toner images formed on the respective photoreceptors Py to Pk are primarily transferred to the intermediate transfer belt B by the primary transfer rollers T1*y* to T1*k*.

Residues and extraneous matter such as discharge products and toner, which remain on the surfaces of the photoreceptors Py to Pk after the primary transfer, are removed by photoreceptor cleaners CLy to CLk. The surfaces of the cleaned photoreceptors Py to Pk are charged again with electricity. Meanwhile, residues, which are not removed by the photoreceptor cleaners CLy to CLk and are attached to the charging rollers CRy to CRk, are removed by charger cleaners CCy, CCm, CCc, and CCk as examples of charger cleaning members that are disposed so as to come into contact with the charging rollers CRy to CRk.

In FIG. 3, a belt module BM as an example of an intermediate transfer device is disposed above the photoreceptors Py to Pk. The belt module BM includes the intermediate transfer belt B. The intermediate transfer belt B is supported by an intermediate transfer supporting system so as to be rotated in a direction that is indicated by an arrow Ya sequentially passing through the primary transfer areas Q4*y* to Q4*k* in the order of Y, M, C, and K colors. The intermediate transfer supporting system includes a belt drive roller Rd as an example of a driving member, a backup roller T2*a* as an example of both a driven member and a secondary transfer facing member, and the primary transfer rollers T1*y* to T1*k* that are disposed so as to face the respective photoreceptors Py to Pk.

A belt cleaner CLb as an example of an intermediate transfer body cleaner is disposed above the right portion of the intermediate transfer belt B. The belt cleaner CLb includes a cleaner container CLb1, a belt cleaning blade CLb2 as an example of a cleaning member that is supported by the cleaner container CLb1 and removes residues remaining on the surface of the intermediate transfer belt B by coming in contact with the intermediate transfer belt B, a film CLb3 as an example of a leakage preventing member that prevents the scattering and leakage of the residues removed by the belt cleaning blade CLb2, and a residue conveying member CLb4 that is disposed in the cleaner container CLb1 and conveys the removed residues to a collecting container (not shown) by discharging the removed residues. Meanwhile, the cleaner container CLb1 of the first example is disposed at a position corresponding to the upper side of the black photoreceptor cleaner CLk.

A secondary transfer roller T2*b* as an example of a secondary transfer member is disposed so as to face the surface of the intermediate transfer belt B that comes into contact with the backup roller T2*a*. A secondary transfer device T2 as an example of a second transfer device includes the backup roller T2*a* and the secondary transfer roller T2*b*. Further, a secondary transfer area Q5 as an example of a second transfer area is formed of areas of the secondary transfer roller T2*b* and the intermediate transfer belt B that face each other.

One-color images that are transferred to the intermediate transfer belt B in the primary transfer areas Q4*y* to Q4*k* by the primary transfer rollers T1*y* to T1*k*, or a multicolor toner image that is formed by sequentially superimposing and transferring the color images to the intermediate transfer belt are conveyed to the secondary transfer area Q5 while being held on the intermediate transfer belt B.

A transfer device T1+T2+B of the first example includes the primary transfer rollers T1*y* to T1*k*, the intermediate transfer belt B, and the secondary transfer device T2.

A sheet feed tray TR1 as an example of a medium receiving part is provided below the visible image forming units UY to UK. The sheet feed tray TR1 includes a bottom wall TR1*a* as an example of a lower wall, a right end wall TR1*b* that extends upward from a right end of the bottom wall TR1*a*, and an upper wall TR1*c* that is disposed above the bottom wall TR1*a* so as to face the bottom wall. A replenishment opening TR1*d* used for the replenishment of new recording sheets S is formed at the left end of the sheet feed tray TR1. The left end of the upper wall TR1*c* is inclined upward toward the outside of the replenishment opening TR1*d*, that is, left side. Accordingly, a distance between the upper wall TR1*c* and the bottom wall TR1*a* is increased toward the left side at the replenishment opening TR1*d*, so that the size of the replenishment opening TR1*d* is increased toward the left side.

A lifting plate PL1 as an example of a medium loading part, which lifts up and down recording sheets S, is disposed on the bottom wall TR1*a*. The lifting plate is supported so as to be rotated about a rotation center PL1*a* and the recording sheets S are loaded on the lifting plate. A lifting spring PL2 as an example of a pushing member, which pushes up the right end portion of the lifting plate PL1, is provided at the right end of the lifting plate PL1. When image formation is not performed, the lifting plate PL1 is moved to a descent position where the lifting plate PL1 is held parallel to the bottom wall TR1*a* by pressing members PL3 that have the shape of an eccentric cam and are disposed at the front and rear ends of the lifting plate. Further, while the image formation is performed, the pressing members PL3 are rotated and are supported so as to be movable between the descent position and an ascent position shown in FIG. 3 where the lifting plate PL1 ascends due to the lifting spring PL2.

Accordingly, when the left cover U2 is opened, the replenishment opening TR1*d* is exposed to the outside. Then, a bundle of new recording sheets S is inserted into the replenishment opening until the recording sheets bump against the right end wall TR1*b*, so that it is possible to load the recording sheets on the lifting plate PL1 that is positioned at the descent position.

A sheet feed roller Rp as an example of a feed member is disposed on the right side of the upper wall TR1*c*. The sheet feed roller Rp is disposed so that the uppermost recording sheet S of the bundle of the loaded recording sheet S is pressed by a spring force of the lifting spring PL2 when the lifting plate PL1 is moved to the ascent position. A retard roller Rs is disposed above the right end wall TR1*b*, as an example of a separating member.

The recording sheets S loaded in the sheet feed tray TR1 are fed by the sheet feed roller Rp, are separated one by one in a contact area between the retard roller Rs and the sheet feed roller Rp, and are conveyed to a sheet conveying passage SH as an example of the conveying passage. The recording sheet S conveyed to the sheet conveying passage SH is conveyed to registration rollers Rr as examples of members that adjusts the feed time of a sheet. The recording sheet S conveyed to the registration rollers Rr is fed to the secondary transfer area Q5 in accordance with the time where a toner image held on the intermediate transfer belt B reaches the secondary transfer area Q5.

Residues such as discharge products and toner remaining on the surfaces of the intermediate transfer belt B, to which the toner image has been transferred in the secondary transfer area Q5, are removed by the belt cleaner CLb, so that the intermediate transfer belt is cleaned.

The recording sheet S to which the toner image is transferred is conveyed to a fixing area Q6 of a fixing device F. The fixing device F includes a heating roller Fh as an example of a heat fixing member and a pressure roller Fp as an example of a pressure fixing member, and the fixing area Q6 is formed of an area where the heating roller Fh and the pressure roller Fp come into contact with each other at a predetermined pressure. The toner image, which is not fixed to the surface of the recording sheet S, is fixed to the recording sheet while passing through the fixing area Q6.

The recording sheet S to which the image is fixed is conveyed along the sheet conveying passage SH, and discharged to the discharge tray TRh from a discharge roller Rh as an example of a medium discharging member.

(Toner Image Detecting Device)

Figure 4:
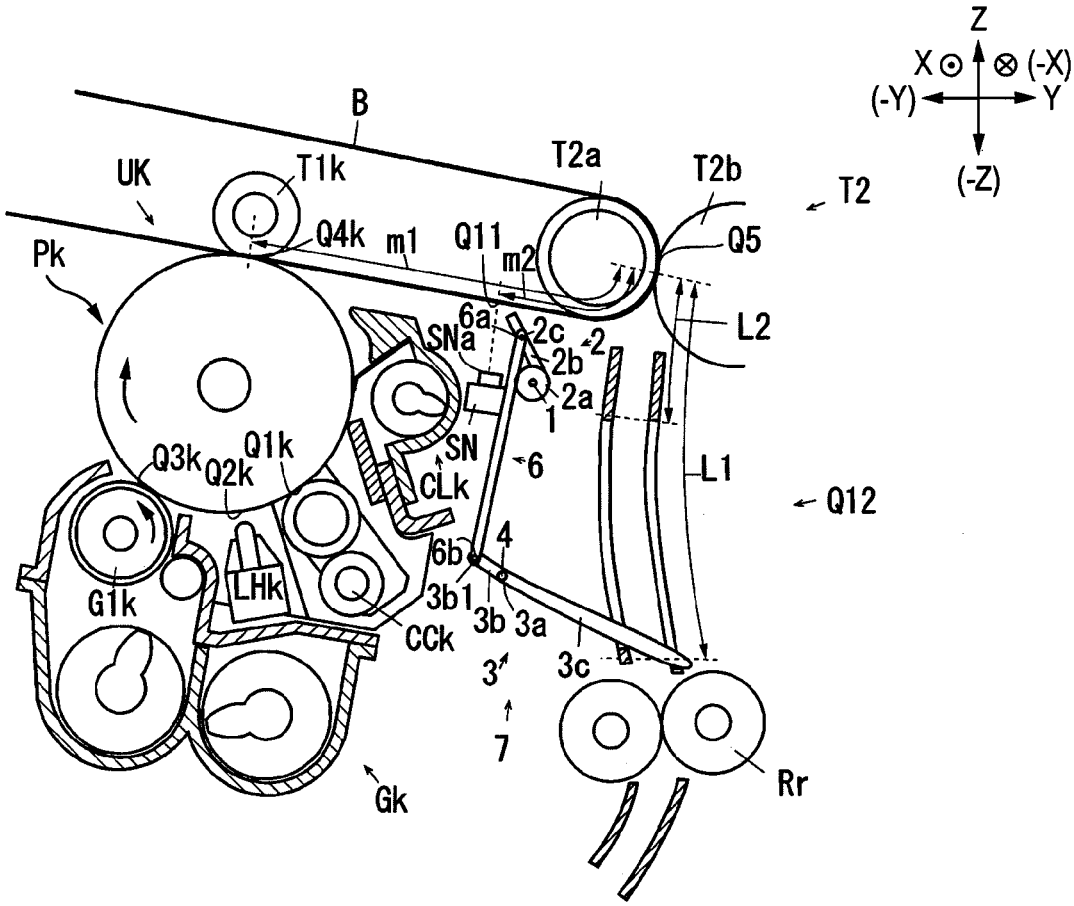
FIG. 4 is an enlarged view of main parts of the image forming apparatus according to the first example of the invention, and is an enlarged view of main parts in the vicinity of a toner image detection area.

FIG. 4 is an enlarged view of main parts of the image forming apparatus according to the first example of the invention, and is an enlarged view of main parts in the vicinity of a toner image detection area.

In FIG. 4, on the intermediate transfer belt B, a toner image detection area Q11 as an example of a predetermined image detection area is set on the upstream of the secondary transfer area Q5 in the rotation direction of the intermediate transfer belt B and downstream of the primary transfer area Q4*k*, which corresponds to a black color, in the rotation direction of the intermediate transfer belt B.

A toner image detecting sensor SN as an example of a visible image detecting unit, which includes a detecting part SNa disposed so as to face the toner image detection area Q11, is disposed below the intermediate transfer belt B. The toner image detecting sensor detects the density or position of the toner image that is formed on the intermediate transfer belt B passing through the toner image detection area Q11.

Meanwhile, the toner image detecting sensor SN of the first example is formed of a so-called optical sensor. The toner image detecting sensor irradiates light to the toner image detection area Q11, and receives light, which is reflected from the toner image formed on the intermediate transfer belt B or the surface of the intermediate transfer belt B, by the detecting part SNa. Accordingly, the toner image detecting sensor detects the density or position of the toner image.

(Sensor Shutter)

Figures 5A, 5B, 5C:
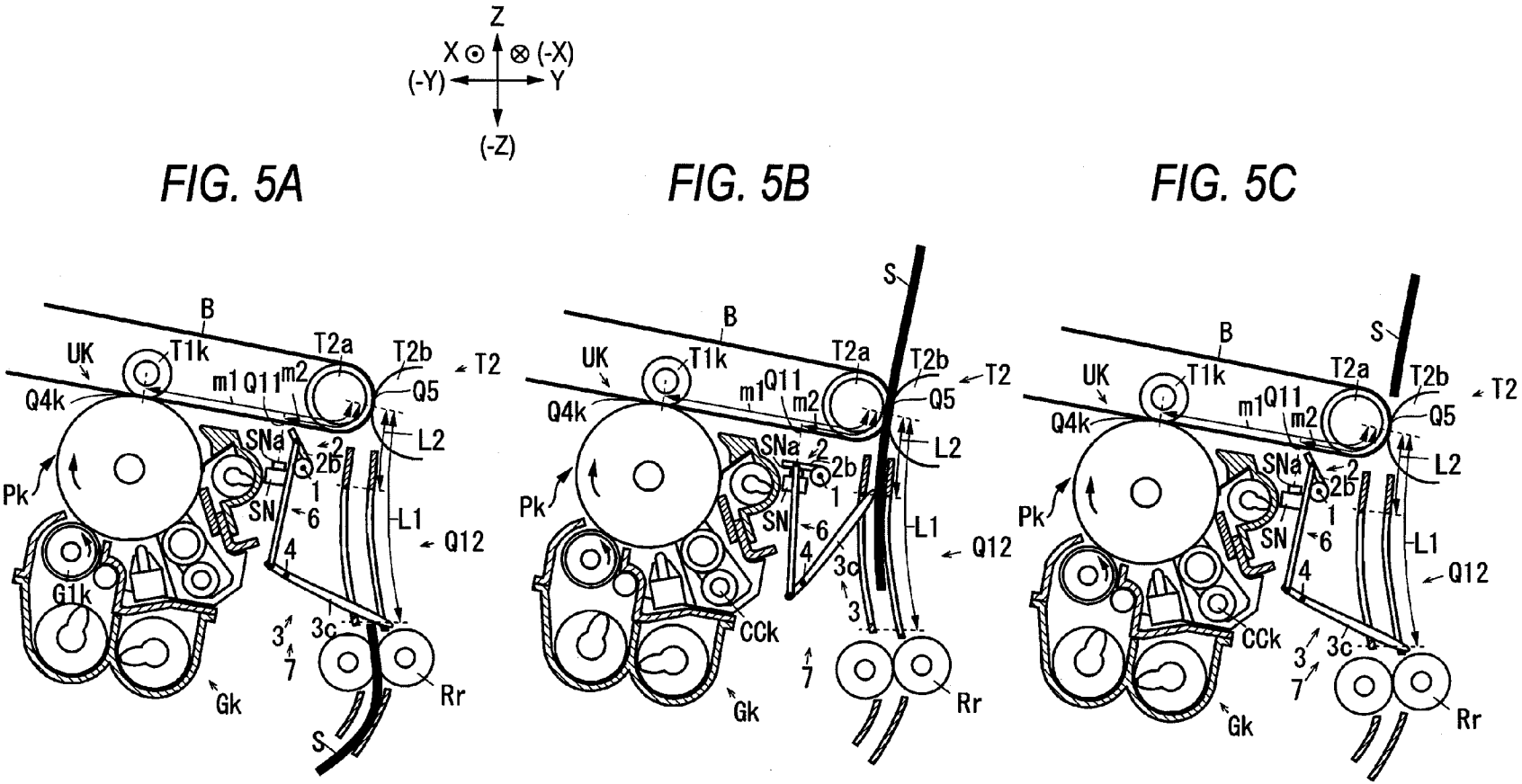
FIGS. 5A to 5*c* are views corresponding to FIG. 4 when a recording sheet passes through a sheet conveying passage.

FIGS. 5A to 5C are views corresponding to FIG. 4 when the recording sheet passes through the sheet conveying passage, FIG. 5A is a view illustrating that the recording sheet enters a sheet detection area, FIG. 5B is a view illustrating that the recording sheet is passing through the sheet detection area, and FIG. 5C is a view illustrating that the recording sheet has passed through the sheet detection area.

A shutter shaft 1 as an example of a shielding member shaft, which extends in the front and rear direction, is supported between the toner image detecting sensor SN and the sheet conveying passage SH.

In FIG. 4, a shutter 2 as an example of a shielding member, which extends in the front and rear direction, is rotatably supported by the shutter shaft 1.

The shutter 2 includes a cylindrical supported part 2*a* that is supported buy the shutter shaft 1, and a plate-like body part 2*b* as an example of a shielding part that extends from the supported part 2*a* toward the toner image detecting sensor SN, and a link connecting part 2*c* as an example of a transmission member connecting part that is formed at the front end of the body part 2*b*.

The body part 2*b* of the shielding member 2 is moved about the shutter shaft 1 between a shielding position shown in FIG. 5B and a detection permitting position shown in FIGS. 5A and 5C. At the shielding position, the body part enters between the detecting part SNa and the toner image detection area Q11 and shields the detecting part SNa. The detection permitting position is set closer to the secondary transfer area Q5 than the shielding position, and the body part 2*b* allows the detecting part SNa to be exposed to the intermediate transfer belt B.

That is, the shutter 2 of the first example is rotated while an angle between the shutter and the surface of the intermediate transfer belt B in the toner image detection area Q11 is changed. The body part 2*b* shields the detecting part SNa at the shielding position while being parallel to the surface of the intermediate transfer belt B. The body part 2*b* is rotated so as to be close to the surface of the intermediate transfer belt B at the detection permitting position in comparison with the shielding position. Accordingly, the body part allows the detecting part SNa to be exposed to the intermediate transfer belt B.

Therefore, the shutter 2 of the first example is positioned at the shielding position near the detecting part SNa and is positioned at the detection permitting position near the secondary transfer area Q5, between the detecting part SNa and the secondary transfer area Q5

(Sheet Contact Member)

In FIG. 4, a sheet detection area Q12 as an example of a medium detection area, which is set along the sheet conveying passage SH upstream of the secondary transfer area Q5 in a medium conveying direction, is set on the sheet conveying passage SH.

A sheet contact member 3 as an example of a medium contact member is supported in the sheet detection area Q12. The sheet contact member 3 includes a supported part 3*a* that is rotatably supported by a medium contact member shaft 4 extending in the front and rear direction.

A transmission arm 3*b* as an example of a medium contact transmission part, which extends to the left side, is formed at a left portion of the supported part 3*a*. A link connecting part 3*b*1 as an example of a transmission member connecting part is formed at the transmission arm 3*b*.

Further, a contact arm 3*c* as an example of a medium contact part, which can come into contact with the recording sheet S passing through the sheet detection area Q12, is formed at a right portion of the supported part 3*a*.

The sheet contact member 3 is supported so as to be rotated about the medium contact member shaft 4. The contact arm 3*c* is rotated about the medium contact member shaft 4 between an entry position shown in FIGS. 5A and 5C and a medium contact position shown in FIG. 5B. At the entry position, the contact arm 3*c* enters the sheet conveying passage SH. At the medium contact position, the contact arm 3*c* comes into contact with the recording sheet S passing through the sheet conveying passage SH and recedes from the entry position.

Further, the centroid of the sheet contact member 3 is always positioned closer to the sheet conveying passage SH than the medium contact member shaft 4.

Accordingly, if the recording sheet S conveyed along the sheet conveying passage SH does not exist, the contact arm 3*c* is held at the entry position by its own weight of the sheet contact member 3.

Further, if the recording sheet S conveyed along the sheet conveying passage SH exists, the contact arm 3*c* of the sheet contact member 3 comes into contact with the front end of the recording sheet S passing through the sheet contact area Q12 in the conveying direction at the entry position. Then, the contact arm is moved to the medium contact position that is set downstream of the entry position in the medium conveying direction, and continues to come into contact with the recording sheet S passing through the sheet contact area Q12 at the medium contact position. Furthermore, when the recording sheet S has passed through the sheet contact area Q12 and the rear end of the recording sheet S in the conveying direction is separated from the contact arm 3*c*, the sheet contact member 3 is rotated by its own weight and the contact arm 3*c* returns to the entry position from the medium contact position.

Herein, the entry position is set so that a moving distance L1 of the recording sheet S conveyed along the sheet conveying passage SH between the secondary transfer area Q5 and the contact arm 3*c* corresponding to the entry position is longer than a moving distance m1 of the toner image held on the intermediate transfer belt B between the secondary transfer area Q5 and the primary transfer area Q4*k* corresponding to a K color.

Further, the medium contact position is set so that a moving distance L2 of the recording sheet S conveyed along the sheet conveying passage SH between the secondary transfer area Q5 and the contact arm 3*c* corresponding to the medium contact position is shorter than a moving distance m2 of the toner image held on the intermediate transfer belt B between the secondary transfer area Q5 and the toner image detection area Q11.

(Link)

In FIG. 4, a link 6 as an example of a rod-like transmission member is connected between the link connecting part 2*c* of the shutter 2 and the link connecting part 3*b*1 of the sheet contact member 3.

A shielding member connecting part 6*a*, which is connected to the link connecting part 2*c*, is formed at one end of the link 6, and the shutter 2 and the link 6 are connected to each other so as to be rotated about the connecting parts 2*c* and 6*a*, respectively. A medium contact member connecting part 6*b*, which is connected to the link connecting part 3*b*1, is formed at the other end of the link 6, and the sheet contact member 3 and the link 6 are connected to each other so as to be rotated about the connecting parts 3*b*1 and 6*b*, respectively.

The shutter shaft 1, the shutter 2, the sheet contact member 3, the medium contact member shaft 4, and the link 6 form a link shutter opening/closing mechanism 7 as an example of a shielding part opening/closing mechanism of the first example.

The link 6 of the link shutter opening/closing mechanism 7 moves the body part 2*b* of the shutter 2 to the shielding position shown in FIG. 5B from the detection permitting position shown in FIGS. 5A and 5C while interlocking with the movement of the contact arm 3*c* of the sheet contact member 3 that is moved to the medium contact position shown in FIG. 5B from the entry position shown in FIGS. 5A and 5C. Further, the link moves the body part 2*b* of the shutter 2 to the detection permitting position from the shielding position while interlocking with the movement of the contact arm 3*c* of the sheet contact member 3 that is moved to the entry position from the medium contact position.

That is, the link shutter opening/closing mechanism 7 is formed of a so-called four-node link, and the shutter 2 is opened and closed while interlocking with the movement of the sheet contact member 3.

(Operation of First Example)

In the image forming apparatus U according to the first example that has the above-mentioned structure, the electrostatic latent images, which are formed on the photoreceptors Py to Pk by the LED heads LHy to LHk, are developed as toner images by the developing units Gy to Gk. In the primary transfer areas Q4*y* to Q4*k*, the toner images are transferred to the intermediate transfer belt B from the photoreceptors Py to Pk by the primary transfer rollers T1*y* to T1*k*. The toner images transferred to the intermediate transfer belt B are conveyed to the secondary transfer area Q5 while being held on the intermediate transfer belt B.

In this case, if the toner image is a toner image for image recording, the toner image formed on the intermediate transfer belt B passes through the toner image detection area Q11 and is conveyed to the secondary transfer area Q5. Then, in the secondary transfer area Q5, the toner image is transferred to the recording sheet S, which is conveyed along the sheet conveying passage SH, from the intermediate transfer belt B by the secondary transfer device T2 in the secondary transfer area Q5.

Further, if the toner image is a toner images used for detecting density or position, that is, a so-called toner patch, the position or density of the toner patch formed on the intermediate transfer belt B is detected in the toner image detection area Q11 by the toner image detecting sensor SN while being conveyed to the secondary transfer area Q5. After that, the toner patch passes through the secondary transfer area Q5, and the toner forming the toner patch is collected from the intermediate transfer belt B by the belt cleaner CLb.

Figure 6B:
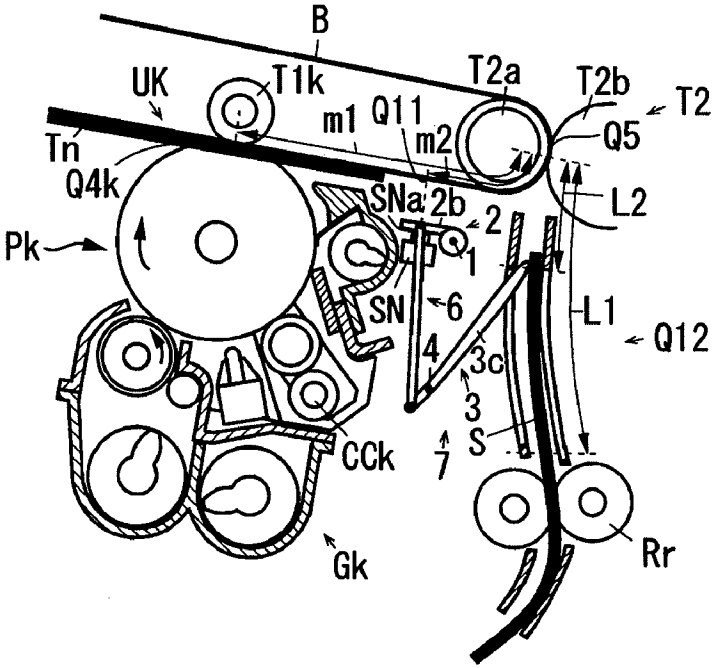
FIGS. 6A to 6D are views illustrating a link shutter opening/closing mechanism of the first example, a toner image for image recording, and a recording sheet.
Figure 6A:
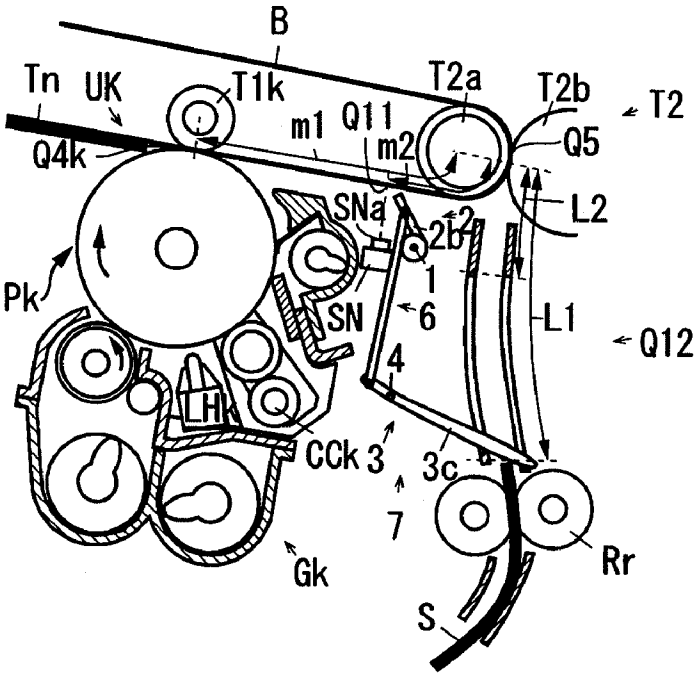
Figure 6A:
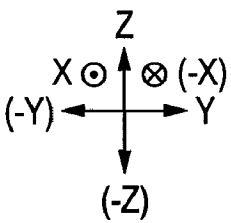
Figure 6D:
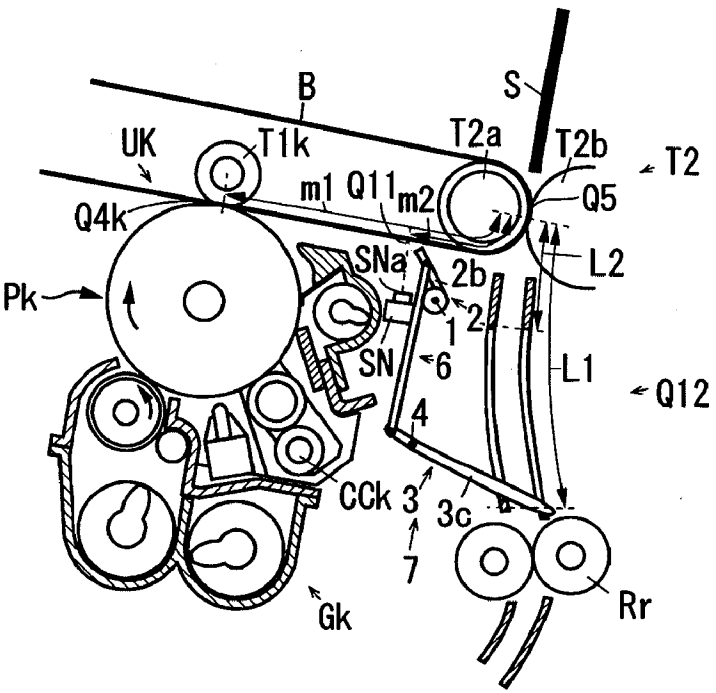
Figure 6C:
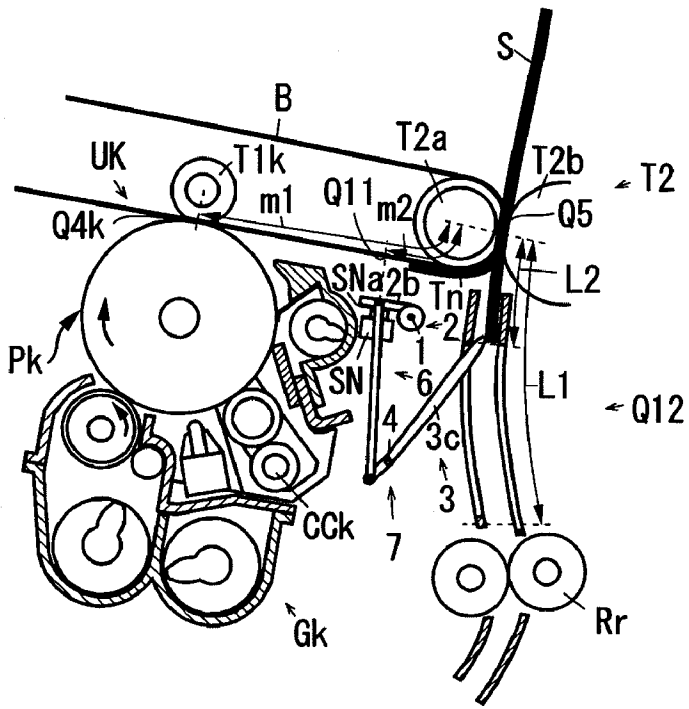
Figure 6C:
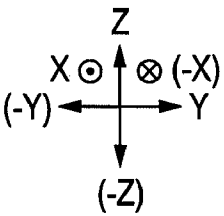

FIGS. 6A to 6D are views illustrating the link shutter opening/closing mechanism of the first example, the toner image for image recording, and the recording sheet, FIG. 6A is a view illustrating that the recording sheet enters the sheet detection area, FIG. 6B is a view illustrating that the recording sheet enters the sheet detection area and is passing through the sheet detection area, FIG. 6C is a view illustrating that the rear end of the recording sheet in the conveying direction passes through the sheet detection area, and FIG. 6D is a view illustrating that the recording sheet has passed through the sheet detection area.

In this case, the image forming apparatus U of the first example protects the detecting part SNa of the toner image detecting sensor SN from the defacement, which is caused by scattered toner, by making the opening/closing movement of the shutter 2 interlock with the sheet contact member 3 that comes into contact with the recording sheet S conveyed along the sheet conveying passage SH and is moved.

That is, in FIGS. 6A to 6B, when a toner image Tn for image recording passes through the toner image detection area Q11, the contact arm 3*c* of the sheet contact member 3 held at the entry position comes into contact with the front end of the recording sheet S in the conveying direction and is moved to the medium contact position that is positioned downstream in the medium conveying direction. In this case, the body part 2*b* of the shutter 2, which interlocks with the movement of the contact arm 3*c* of the sheet contact member 3 through the link 6, is moved to the shielding position shown in FIG. 6B from the detection permitting position shown in FIG. 6A, so that the detecting part SNa of the toner image detecting sensor SN is shielded and protected.

Further, in FIGS. 6C to 6D, if the recording sheet S, which comes into contact with the contact arm 3*c* held at the medium contact position, passes through the sheet detection area Q12 and is separated from the contact arm 3*c* when the toner image Tn for image recording passes through the toner image detection area Q11, the contact arm 3*c* is moved to the entry position from the medium contact position by its own weight of the sheet contact member 3. In this case, the shutter 2 is moved to the detection permitting position shown in FIG. 6D from the shielding position shown in FIG. 6C by the link 6 while interlocking with the movement of the sheet contact member 3 from the medium contact position to the entry position. As a result, the detecting part SNa is exposed to the intermediate transfer belt B.

In addition, when the toner patch passes through the toner image detection area Q11, the contact arm 3*c* is held at the entry position by its own weight of the sheet contact member 3 without the conveyance of the recording sheet S and the body part 2*b* of the shutter 2, which interlocks with the movement of the contact arm through the link 6, is also held at the detection permitting position. Accordingly, when the toner patch passes through the toner image detection area Q11, the toner patch passing through the toner image detection area Q11 is detected by the toner image detecting sensor SN while the detecting part SNa is exposed to the intermediate transfer belt B.

Here, if the body part 2*b* of the shutter 2 is not adapted to be opened and closed while interlocking with the contact arm 3*c* of the sheet contact member 3 moved by the contact between the recording sheet S and the contact arm and its own weight, for example, if the body part is adapted to be opened and closed by a solenoid or a motor as an example of an electromagnetic drive unit, the size of the entire image forming apparatus is apt to be increased and the manufacturing cost thereof is apt to be increased.

In contrast, in the image forming apparatus U according to the first example, the shutter 2 is adapted to be opened and closed while interlocking with the contact arm 3*c* of the sheet contact member 3 moved by the contact between the recording sheet S and the contact arm and its own weight. Accordingly, in comparison with a case where this structure is not employed, the increase of the size of the image forming apparatus is suppressed and the detecting part SNa is protected by inexpensive structure.

Further, in the image forming apparatus U according to the first example, the moving distance L1 of the recording sheet S conveyed along the sheet conveying passage SH between the secondary transfer area Q5 and the contact arm 3*c* corresponding to the entry position is set to be longer than the moving distance m1 of the toner image Tn held on the intermediate transfer belt B between the secondary transfer area Q5 and the primary transfer area Q4*k* corresponding to a K color.

Accordingly, as shown in FIGS. 6A and 6B, after the recording sheet S comes into contact with the contact arm 3*c* corresponding to the entry position, the toner image Tn, which is transferred to the intermediate transfer belt B in the most downstream primary transfer area Q4*k* corresponding to a K color, is moved to the secondary transfer area Q5.

That is, in the image forming apparatus U according to the first example, before the toner image Tn held on the intermediate transfer belt B is moved to the downstream toner image detection area Q11 from the most downstream primary transfer area Q4*k*, the shutter 2 interlocking with the sheet contact member 3 is moved so that the detecting part SNa of the toner image detecting sensor SN is shielded.

Accordingly, in comparison with the structure where the detecting part SNa is shielded after the toner image Tn, which corresponds to the front end in the moving direction, passes through the toner image detection area Q11, it may be possible to suppress the defacement of the detecting part SNa caused by the scattering of the toner forming the toner image Tn, which corresponds to the front end in the moving direction, in the first example.

In particular, in the first example, the detecting part SNa is shielded before the toner image Tn, which corresponds to the front end in the moving direction, is moved to the downstream side of the most downstream primary transfer area Q4*k*. Accordingly, in comparison with the structure where the detecting part SNa is shielded immediately before the toner image Tn, which corresponds to the front end in the moving direction, is moved to the toner image detection area Q11, it may be possible to suppress the defacement of the detecting part SNa caused by the scattering of the toner forming the toner image Tn, which corresponds to the front end in the moving direction, in the first example.

In addition, in the image forming apparatus U according to the first example, the moving distance L2 of the recording sheet S conveyed along the sheet conveying passage SH between the secondary transfer area Q5 and the contact arm 3*c* corresponding to the medium contact position is set to be shorter than the moving distance m2 of the toner image Tn held on the intermediate transfer belt B between the secondary transfer area Q5 and the toner image detection area Q11.

Accordingly, as shown in FIGS. 6C and 6D, after the toner image Tn held on the intermediate transfer belt B passes through the toner image detection area Q11, the recording sheet S is separated from the contact arm 3*c* corresponding to the medium contact position.

That is, in the image forming apparatus U according to the first example, after the toner image Tn held on the intermediate transfer belt B passes through the toner image detection area Q11, the body part 2*b* of the shutter 2 interlocking with the contact arm 3*c* of the sheet contact member 3 is moved to the detection permitting position from the shielding position so that the detecting part SNa is exposed to the intermediate transfer belt B.

Accordingly, in comparison with the structure where the detecting part SNa is exposed to the intermediate transfer belt B before the toner image Tn, which corresponds to the rear end in the moving direction, passes through the toner image detection area Q11, it may be possible to suppress the defacement of the detecting part SNa caused by the scattering of the toner forming the toner image Tn, which corresponds to the rear end in the moving direction, in the image forming apparatus U according to the first example.

Further, in the image forming apparatus U according to the first example, the body part 2*b* of the shutter 2 is disposed between the toner image detecting sensor SN and the secondary transfer area Q5 at the detection permitting position that is set closer to the secondary transfer area Q5 than the shielding position.

That is, even though a part of the toner forming the toner image Tn is scattered when the toner image Tn held on the intermediate transfer belt B is transferred to the recording sheet S in the secondary transfer area Q5, it may be possible to prevent the scattered toner from being moved to the detecting part SNa from the secondary transfer area Q5 by the body part 2*b* of the shutter 2 that is disposed between the toner image detecting sensor SN and the secondary transfer area Q5.

Accordingly, in comparison with a case where the body part 2*b* of the shutter 2 corresponding to the detection permitting position is not disposed between the toner image detecting sensor SN and the secondary transfer area Q5, it may be possible to suppress the defacement of the exposed detecting part SNa caused by the toner, which is scattered when the toner image is transferred to the recording sheet S in the secondary transfer area Q5, in the image forming apparatus U according to the first example.

Second Example

A second example of the invention will be described below. Meanwhile, in the description of the second example, components corresponding to the components of the first example are denoted by the same reference numerals and the detailed description thereof will be omitted.

This example is different from the first example in terms of the following, but has the same structure as the first example except for the following.

Figures 7A, 7B, 7C:
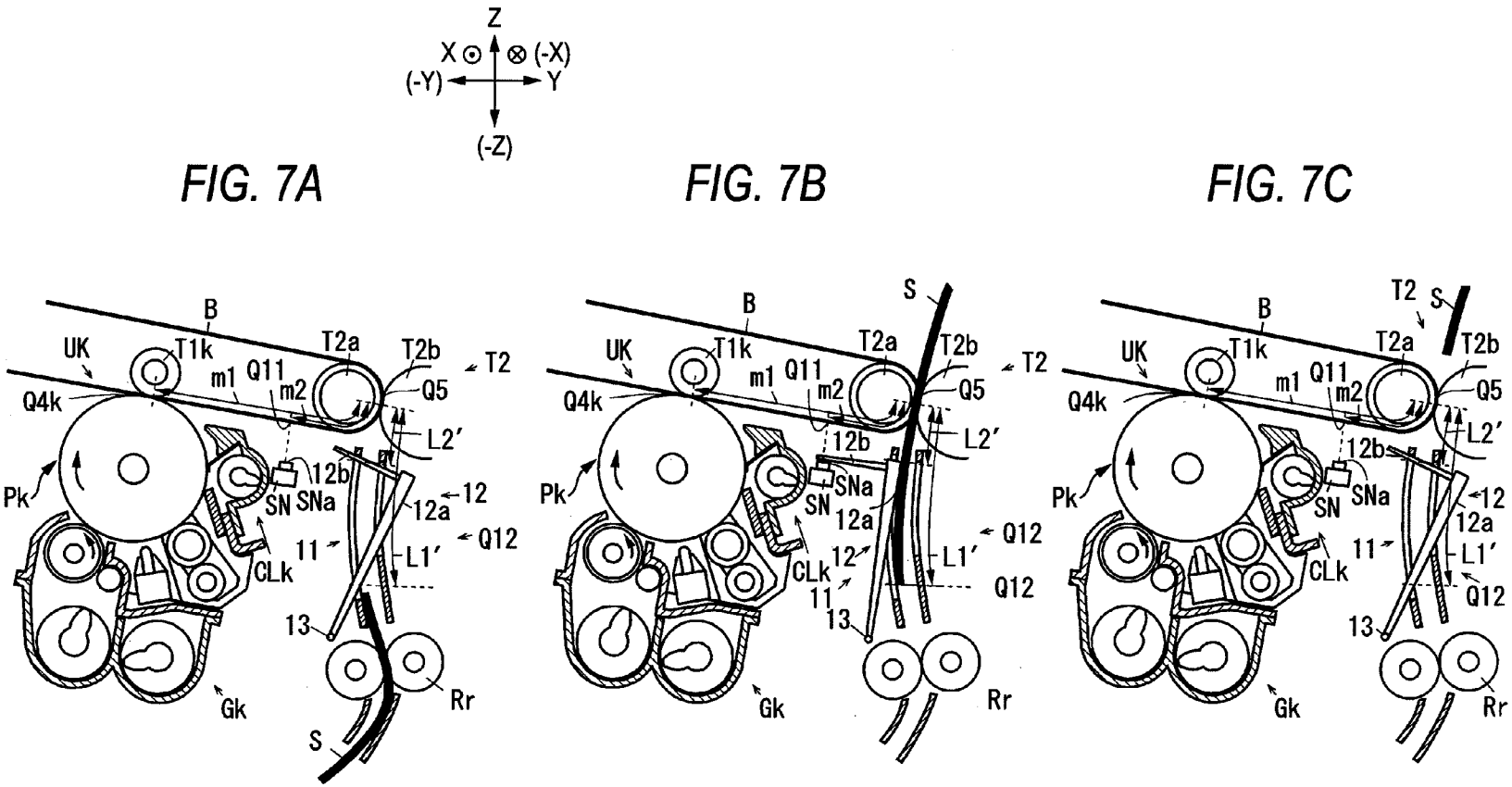
FIGS. 7A to 7C are views that illustrate an integrated shutter opening/closing mechanism of a second example and correspond to FIGS. 5A to 5C of the first example.

FIGS. 7A to 7C are views that illustrate an integrated shutter opening/closing mechanism of a second example and correspond to FIGS. 5A to 5C of the first example, FIG. 7A is a view illustrating that a recording sheet enters a sheet detection area, FIG. 7B is a view illustrating that the recording sheet is passing through the sheet detection area, and FIG. 7C is a view illustrating that the recording sheet has passed through the sheet detection area.

In FIGS. 7A to 7C, an image forming apparatus U according to the second example includes an integrated shutter opening/closing mechanism 11 as an example of a shielding part opening/closing mechanism, instead of the link shutter opening/closing mechanism 7.

The integrated shutter opening/closing mechanism 11 includes a reciprocating member 12, which has a fan-shaped cross section, as an example of a rotatable member. The central portion of the fan-shaped reciprocating member 12 is rotatably supported by a reciprocating member shaft 13 as an example of a shaft that extends in the front and rear direction.

A sheet contact part 12*a* as an example of a medium contact part, which comes into contact with the recording sheet S passing through the sheet detection area Q12, is formed integrally with the side surface of the reciprocating member 12 facing the sheet conveying passage SH.

Further, a shutter part 12*b* as an example of a plate-like shielding part, which extends toward a gap between the detecting part SNa and the toner image detection area Q11, is formed integrally with the side surface of the reciprocating member 12 facing the toner image detecting sensor SN.

The centroid of the reciprocating member 12 of the integrated shutter opening/closing mechanism 11 is always positioned closer to the sheet conveying passage SH than the reciprocating member shaft 13.

For this reason, like in the first example, the reciprocating member 12 of the integrated shutter opening/closing mechanism 11 is moved by the contact between the reciprocating member and the recording sheet S, which passes through the sheet detection area Q12, and its own weight. Accordingly, the reciprocating member reciprocates so as to be rotated about the reciprocating member shaft 13.

That is, the sheet contact part 12*a* of the integrated shutter opening/closing mechanism 11 reciprocates so as to be rotated between an entry position shown in FIGS. 7A and 7C and a medium contact position shown in FIG. 7B by its own weight of the reciprocating member 12 of the integrated shutter opening/closing mechanism 11. At the entry position, the sheet contact part enters the sheet conveying passage SH. At the medium contact position, the sheet contact part comes into contact with the recording sheet S passing through the sheet conveying passage SH and recedes from the entry position.

Further, in this case, the shutter part 12*b* reciprocates so as to be rotated between a shielding position shown in FIG. 7B and a detection permitting position shown in FIGS. 7A and 7C. At the shielding position, the shutter part enters between the detecting part SNa and the toner image detection area Q11 and shields the detecting part SNa. The detection permitting position is set closer to the secondary transfer area Q5 than the shielding position, and the shutter part allows the detecting part SNa to be exposed to the intermediate transfer belt B.

Meanwhile, the entry position is set so that a moving distance L1' of the recording sheet S conveyed along the sheet conveying passage SH between the secondary transfer area Q5 and the sheet contact part 12*a* corresponding to the entry position is longer than the moving distance m1.

Further, the medium contact position is set so that a moving distance L2' of the recording sheet S conveyed along the sheet conveying passage SH between the secondary transfer area Q5 and the sheet contact part 12*a* corresponding to the medium contact position is shorter than the moving distance m2.

(Operation of Second Example)

In the image forming apparatus U according to the second example that has the above-mentioned structure, the sheet contact part 12*a* coming into contact with the recording sheet S and the shutter part 12*b* shielding the detecting part SNa are formed integrally with the reciprocating member 12, and the shutter part 12*b* and the sheet contact part 12*a* are moved together with each other as a single body due to the contact between the sheet contact part and the recording sheet S and its own weight. As a result, the shutter part allows the detecting part SNa to be opened and closed.

Meanwhile, in the link shutter opening/closing mechanism 7 of the first example, the detecting part SNa has been opened and closed through the link 6 by the body part 2*b* of the shutter 2 that is formed separately from the sheet contact member 3 including the contact arm 3*c*. However, in the integrated shutter opening/closing mechanism 11 of the second example, the detecting part SNa is opened and closed by the shutter part 12*b* that is formed integrally with the reciprocating member 12 together with the sheet contact part 12*a*. Accordingly, the number of parts of the second example is reduced in comparison with that of the first example.

Therefore, in the second example, the detecting part SNa is opened and closed by the structure of which the number of parts is reduced in comparison with that of the first example, due to the contact between the sheet contact part and the recording sheet S passing through the sheet detection area Q11 and its own weight. As a result, it may be possible to suppress the defacement of the detecting part SNa caused by the toner, like in the first example.

Third Example

A third example of the invention will be described below. Meanwhile, in the description of the third example, components corresponding to the components of the first example are denoted by the same reference numerals and the detailed description thereof will be omitted.

This example is different from the first example in terms of the followings, but has the same structure as the first example except for the followings.

Figure 8:
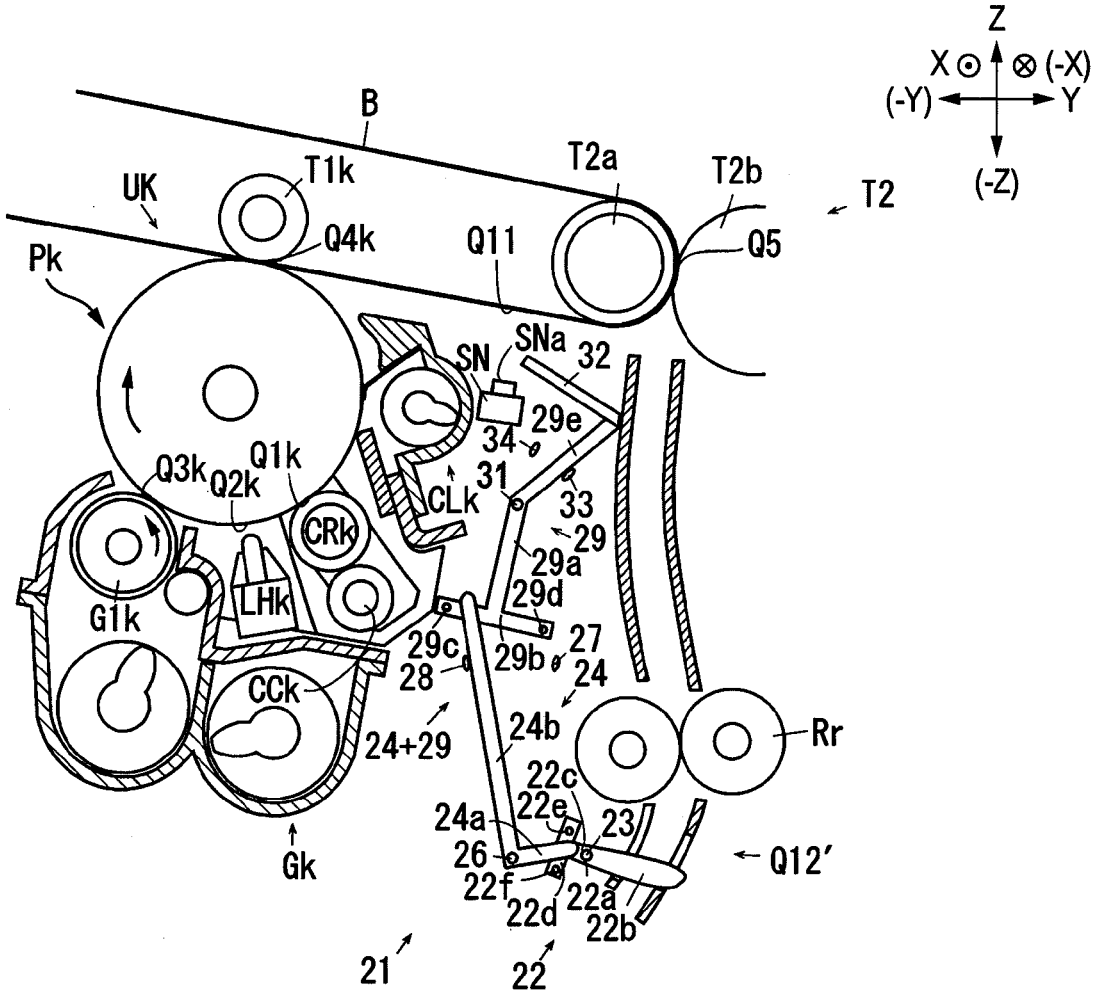
FIG. 8 is a view illustrating a delay shutter opening/closing mechanism of a third example, and is a view corresponding to FIG. 4 of the first example.

FIG. 8 is a view illustrating a delay shutter opening/closing mechanism of a third example, and is a view corresponding to FIG. 4 of the first example.

In FIG. 8, an image forming apparatus U according to the third example includes a delay shutter opening/closing mechanism 21 as an example of a shielding part opening/closing mechanism, instead of the link shutter opening/closing mechanism 7. The delay shutter opening/closing mechanism 21 includes a sheet-passing contact member 22 as an example of a medium contact member, which is disposed in a pre-registration sheet detection area Q12' as an example of a medium detection area, which is set along the sheet conveying passage SH on the upstream side of the registration rollers Rr in the medium conveying direction, instead of the sheet detection area Q12 of the first example.

Figure 9B:
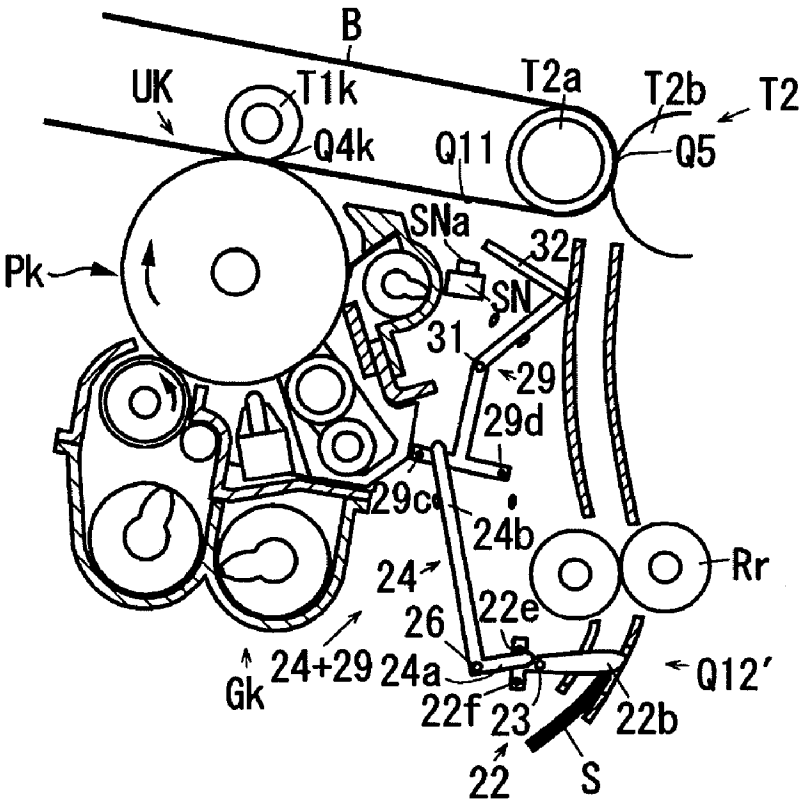
FIGS. 9A to 9F are views that illustrate a delay shutter opening/closing mechanism of a third example and are views illustrating that a recording sheet passes through a pre-registration sheet detection area.
Figure 9A:
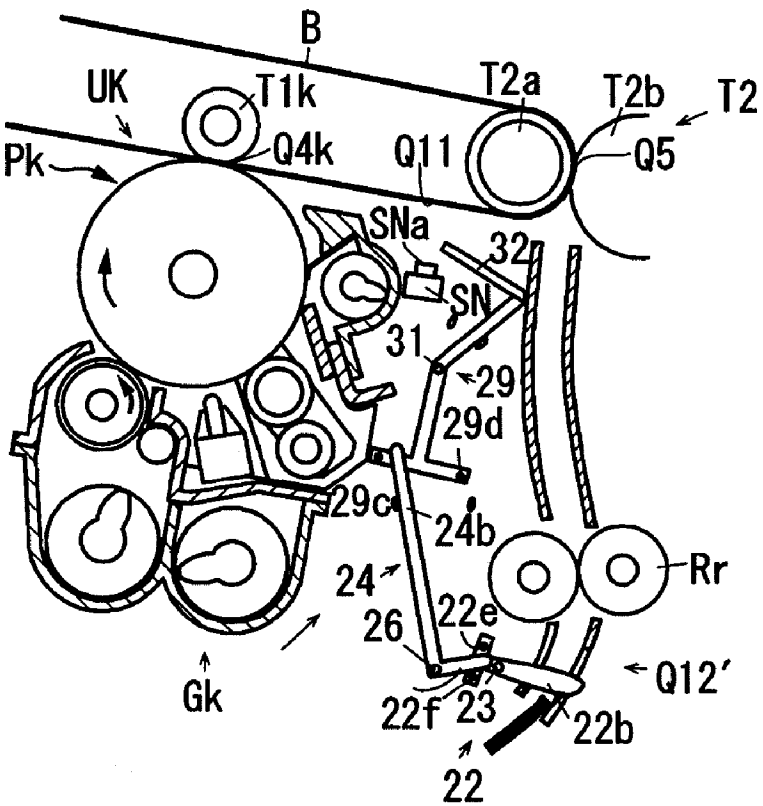
Figure 9D:
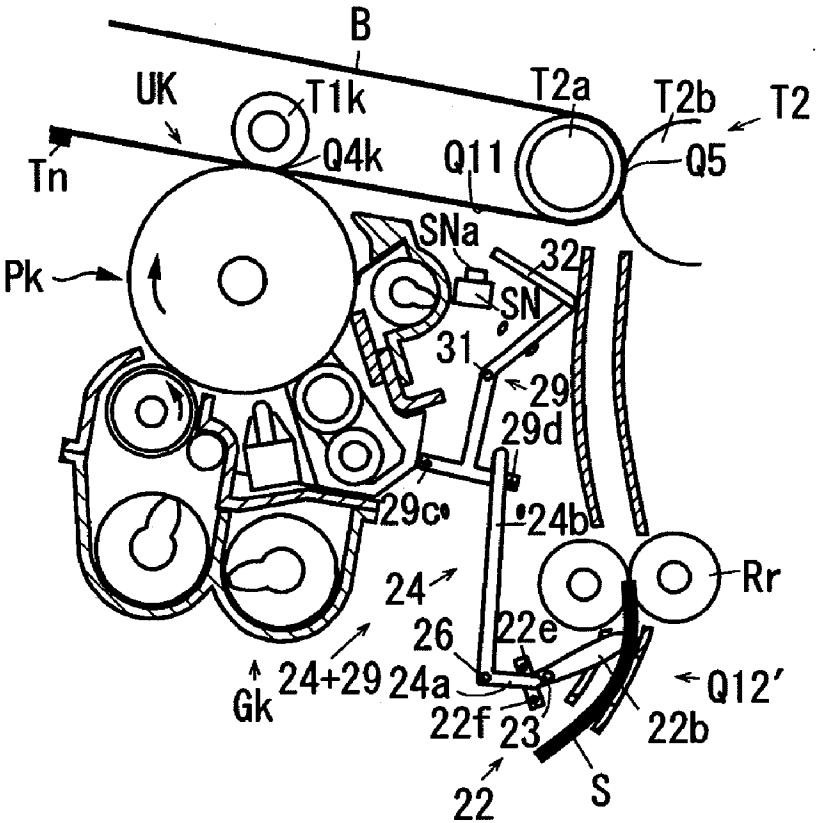
Figure 9C:
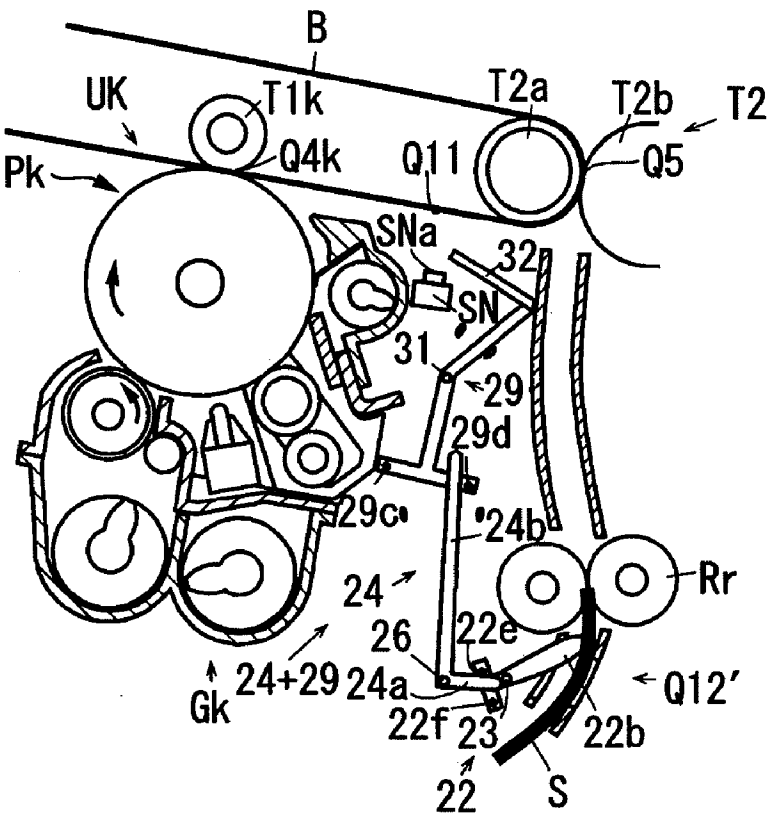
Figure 9F:
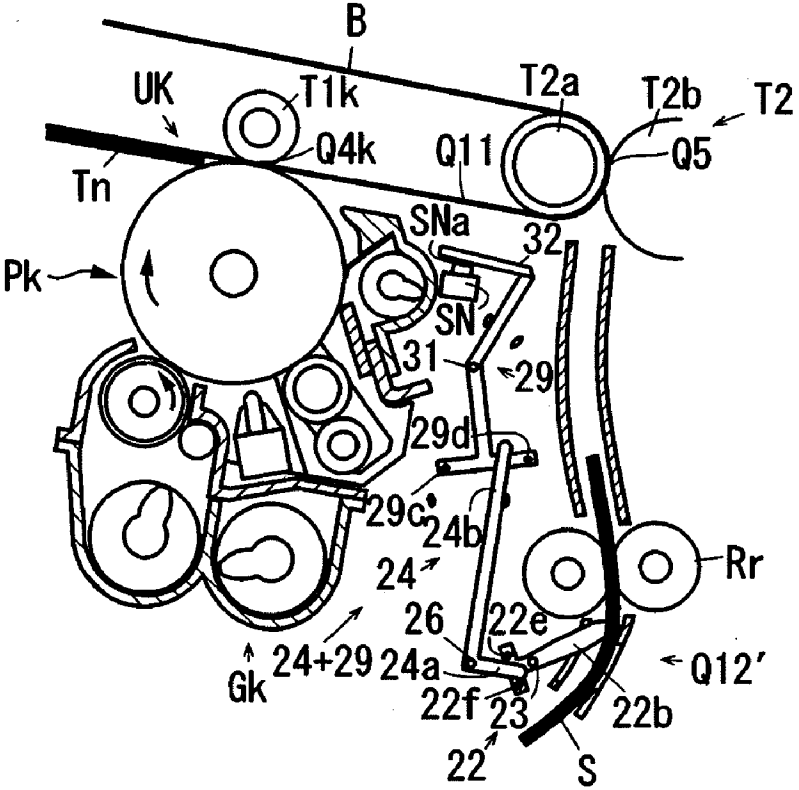
Figure 9E:
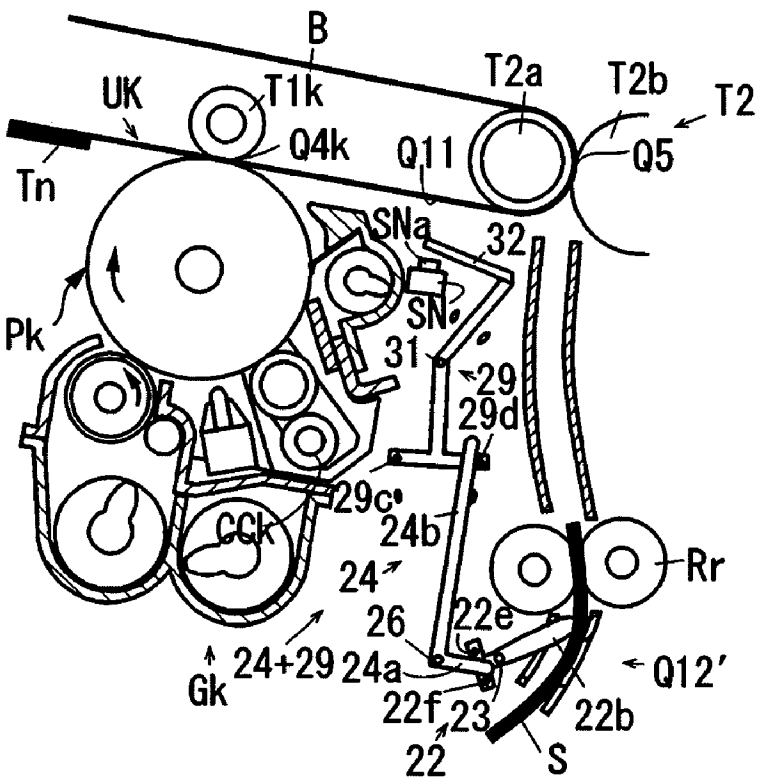

FIGS. 9A to 9F are views that illustrate the delay shutter opening/closing mechanism of the third example and are views illustrating that a recording sheet passes through the pre-registration sheet detection area. FIG. 9A is a view illustrating that the sheet-passing contact member is held at the entry position, a first seesaw arm is held at the stop position close to a visible image detecting unit, and a second seesaw arm is held at the permission stop position. FIG. 9B is a view following FIG. 9A, and is a view illustrating that the sheet-passing contact member is moved to the medium contact position from an entry position. FIG. 9C is a view following FIG. 9B, and is a view illustrating that the first seesaw arm is moved to the conveying passage-side stop position. FIG. 9D is a view following FIG. 9C, and is a view illustrating that the first seesaw arm comes into contact with the second seesaw arm. FIG. 9E is a view following FIG. 9D, and is a view illustrating that the second seesaw arm is moved to the shielding stop position. FIG. 9F is a view following FIG. 9E, and is a view illustrating that the second seesaw arm has been moved to the stop position at the time of shielding.

Figure 10B:
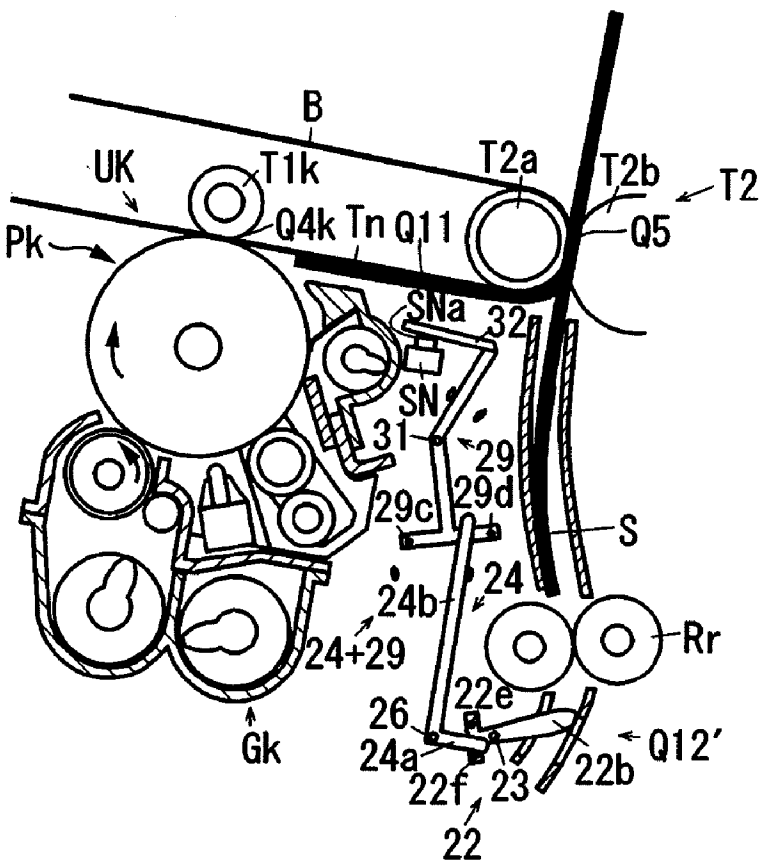
FIGS. 10A to 10F are views following FIG. 9F.
Figure 10A:
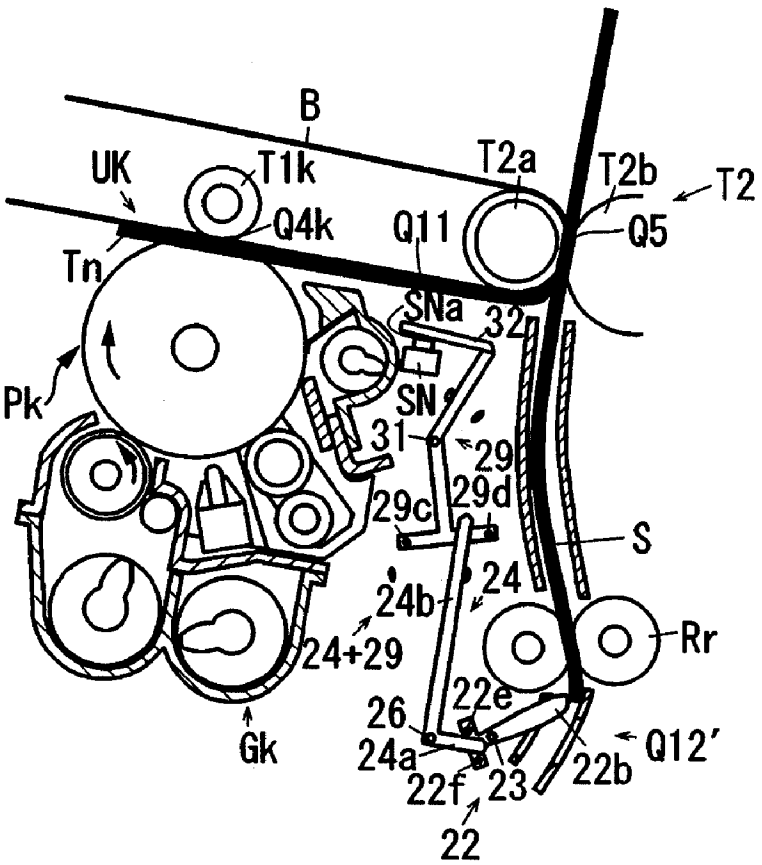
Figure 10D:
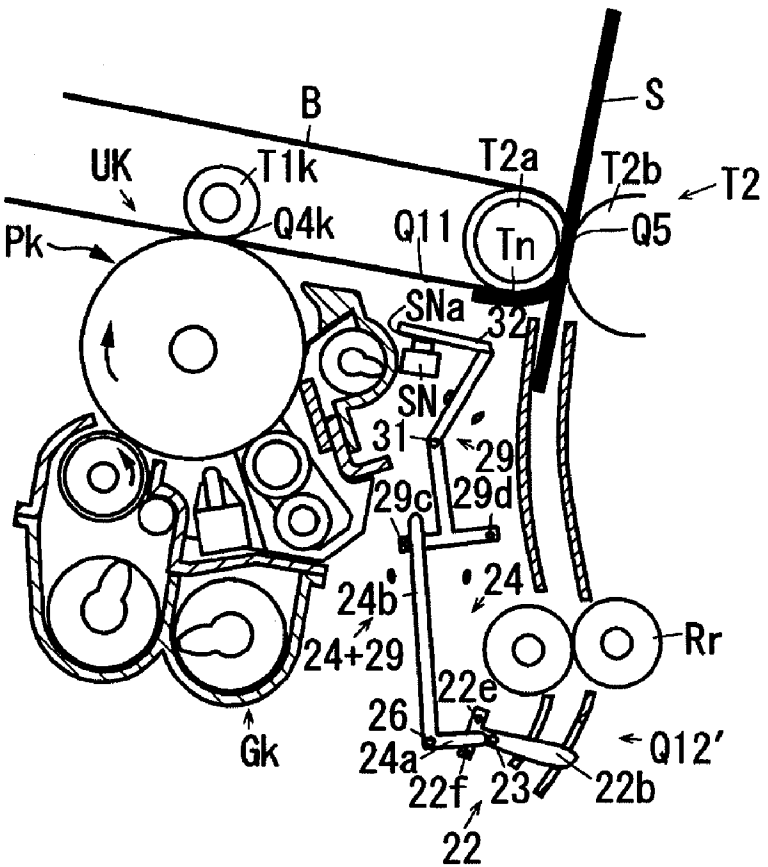
Figure 10C:
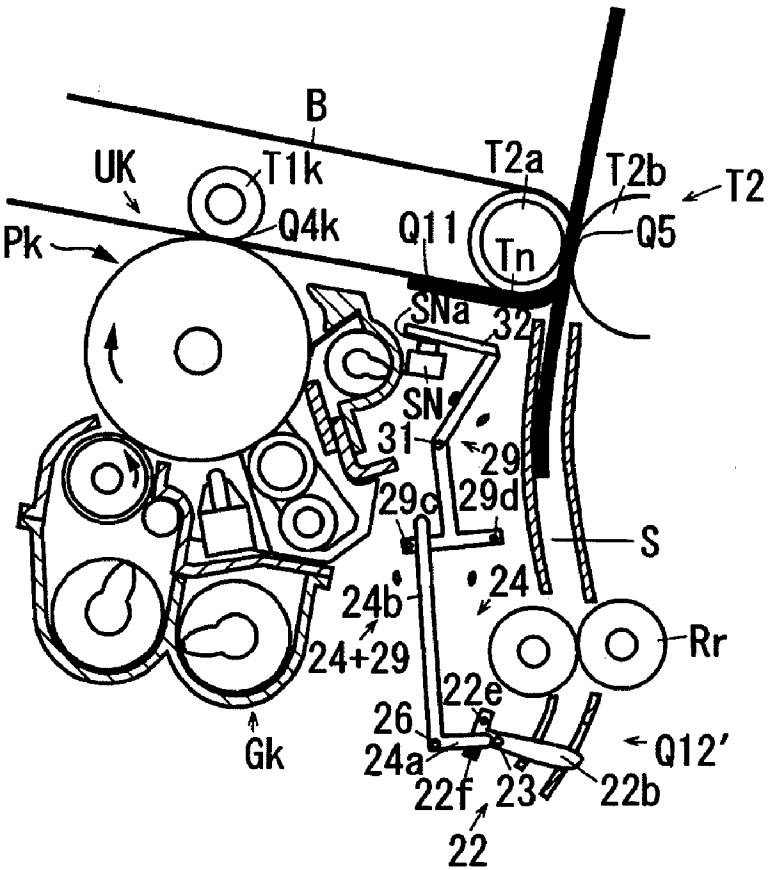
Figure 10F:
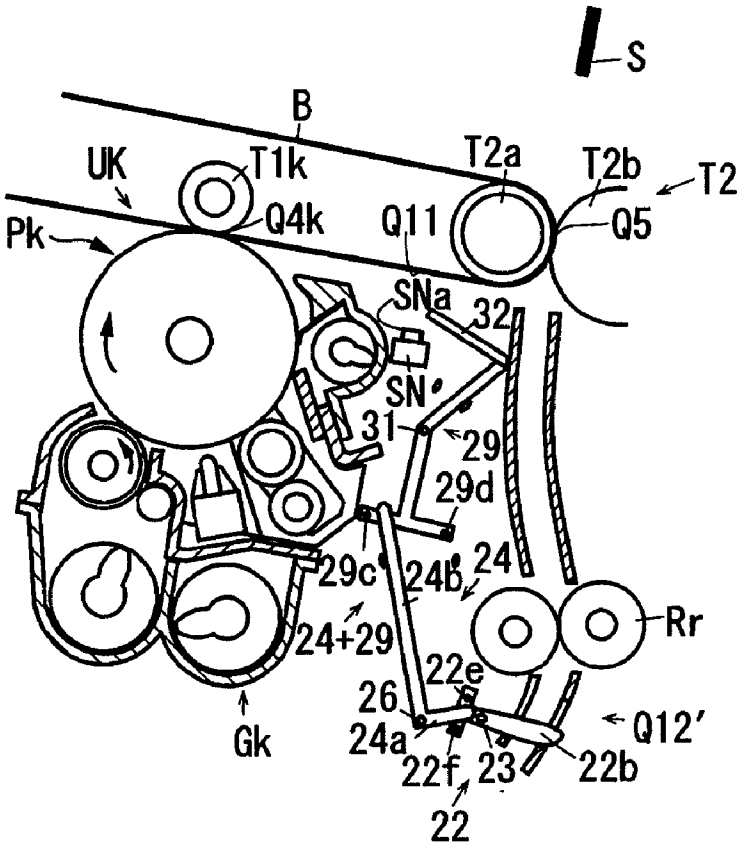
Figure 10E:
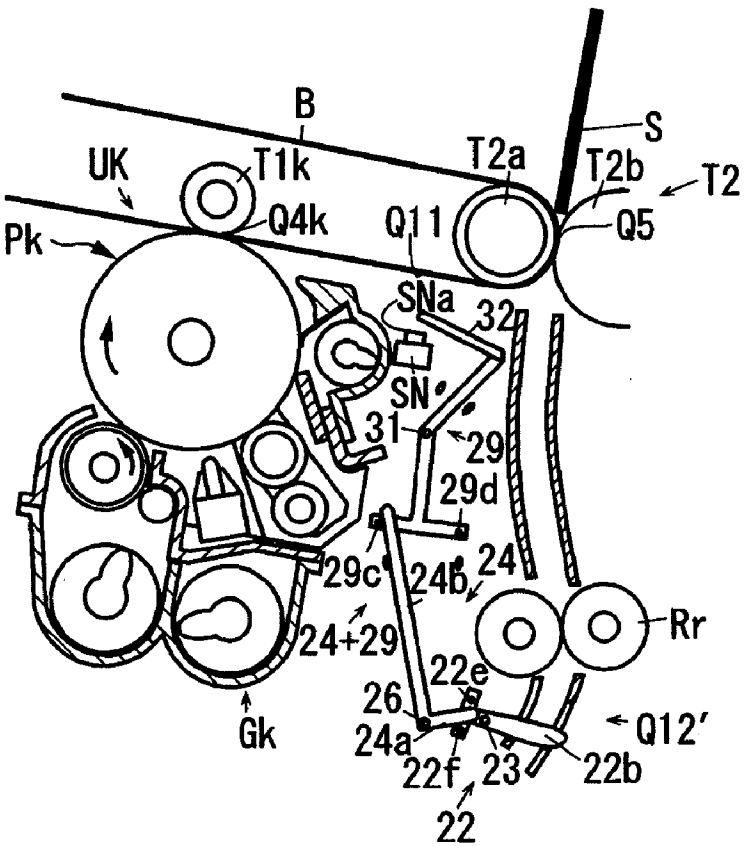

FIGS. 10A to 10F are views following FIG. 9F. FIG. 10A is a view illustrating that the sheet-passing contact member is held at the medium contact position, the first seesaw arm is held at the conveying passage-side stop position, and the second seesaw arm is held at the shielding stop position. FIG. 10B is a view following FIG. 10A, and is a view illustrating that the sheet-passing contact member is moved to the entry position from the medium contact position. FIG. 100 is a view following FIG. 10B, and is a view illustrating that the first seesaw arm is moved to the visible image detecting unit-side stop position. FIG. 10D is a view following FIG. 100, and is a view illustrating that the first and second seesaw arms come into contact with each other. FIG. 10E is a view following FIG. 10D, and is a view illustrating that the second seesaw arm is moved to the permission stop position. FIG. 10F is a view following FIG. 10E, and is a view illustrating that the second seesaw arm is moved to the permission stop position.

(Sheet-Passing Contact Member)

In FIG. 8, the sheet-passing contact member 22 includes a supported part 22*a* that is rotatably supported by a medium contact member shaft 23 extending in the front and rear direction.

A contact arm 22*b* as an example of a medium contact part, which extends to the sheet conveying passage SH and can come into contact with the recording sheet S passing through the pre-registration sheet detection area Q12', is formed at a right portion of the supported part 22*a*.

The sheet-passing contact member 22 is supported so as to be rotated about the medium contact member shaft 23. The contact arm 22*b* is rotated about the medium contact member shaft 23 between an entry position shown in FIG. 9A and a medium contact position shown in FIG. 10A. At the entry position, the contact arm 22*b* enters the sheet conveying passage SH. At the medium contact position, the contact arm 22*b* comes into contact with the recording sheet S passing through the sheet conveying passage SH and recedes from the entry position.

In FIG. 8, a transmission arm 22*c* as an example of a medium contact transmission part, which extends to the left side, is formed at a left portion of the supported part 22*a*. A plate-like contact/separation part supporting plate 22*d*, which extends in the vertical direction, is formed integrally with the end of the transmission arm 22*c*. Upper and lower (a pair of) contact/separation parts 22*e* and 22*f* as an example of a medium-side contact/separation part are formed at the contact/separation part supporting plate 22*d*.

Further, the centroid of the sheet-passing contact member 22 is always positioned closer to the sheet conveying passage SH than the medium contact member shaft 23.

(First Seesaw Arm)

In FIG. 8, a first seesaw arm 24 as an example of a first transmission member is disposed on the left side of the sheet-passing contact member 22.

A first transmitted part 24*a* as an example of a first transmission-side contact part, which is disposed between the upper and lower contact/separation parts 22*e* and 22*f* of the sheet-passing contact member 22 extending in the left and right direction, is formed at the first seesaw arm 24. A left end of the first transmitted part 24*a* is rotatably supported by a first arm shaft 26 as an example of a first transmission member shaft, and can come into contact with and be separated from the upper and lower contact/separation parts 22*e* and 22*f*.

A transmission contact/separation part 24*b*, which extends upward, is formed at the left end of the first transmitted part 24*a*.

A first right stopper 27 as an example of a conveying passage-side regulation part is provided on the right side of the transmission contact/separation part 24*b* of the first seesaw arm 24, and the first right stopper 27 regulates the rotation of the first seesaw arm 24 by coming in contact with the transmission contact/separation part 24*b*. Further, a first left stopper 28 as an example of a visible image detecting unit-side regulation part is provided on the left side of the transmission contact/separation part 24*b*, and the first left stopper 28 regulates the rotation of the first seesaw arm 24 by coming in contact with the transmission contact/separation part 24*b*.

The first seesaw arm 24 is formed so that the centroid of the first seesaw arm is positioned above the first arm shaft 26 while the first seesaw arm is separated from each of the stoppers 27 and 28. Accordingly, when the centroid of the first seesaw arm is positioned on the right side of the first arm shaft 26, the first seesaw arm 24 is rotated by its own weight and moved to the conveying passage-side stop position shown in FIG. 10A where the first seesaw arm comes into contact with the first right stopper 27. Further, when the centroid of the first seesaw arm is positioned on the left side of the first arm shaft 26, the first seesaw arm is rotated by its own weight and moved to the visible image detecting unit-side stop position shown in FIG. 9A where the first seesaw arm comes into contact with the first left stopper 28.

(Second Seesaw Arm and Delay Shutter)

A second seesaw arm 29 as an example of a second transmission member is disposed above the first seesaw arm 24.

The second seesaw arm 29 includes a lower arm 29*a* as an example of a lower arm part that extends in the vertical direction. An upper end of the lower arm 29*a* is rotatably supported by a second arm shaft 31 as an example of a second transmission member shaft. A plate-like contact/separation part supporting plate 29*b*, which extends in the left and right direction, is formed integrally with a lower end of the lower arm 29*a*. Left and right (a pair of) transmitted parts 29*c* and 29*d* as an example of a second transmission-side contact/separation part are formed at the contact/separation part supporting plate 29*b*. The transmission contact/separation part 24*b* of the first seesaw arm 24 is disposed between the respective transmitted parts 29*c* and 29*d*, and the respective transmitted parts 29*c* and 29*d* can come into contact with and be separated from the transmission contact/separation part 24*b* that is to be rotated.

An upper arm 29*e* as an example of an upper arm part, which extends upward toward the right side, is formed at the upper end of the lower arm 29*a*. A delay shutter 32 as an example of a plate-like shielding part, which extends toward a gap between the detecting part SNa of the toner image detecting sensor SN and the toner image detection area Q11 formed on the intermediate transfer belt B, is supported by an upper end of the upper arm 29*e*.

A second right stopper 33 as an example of a regulation part for permission is provided on the right side of the upper arm 29*e* of the second seesaw arm 29, and the second right stopper 33 regulates the rotation of the second seesaw arm 29 by coming in contact with the upper arm 29*e*. Further, a second left stopper 34 as an example of a regulation part for shielding is provided on the left side of the upper arm 29*e*, and the second left stopper 34 regulates the rotation of the second seesaw arm 29 by coming in contact with the second seesaw arm 29.

The second seesaw arm 29 supporting the delay shutter 32 is formed so that the centroid of the whole of the second seesaw arm 29 and the delay shutter 32 is positioned above the second arm shaft 31 and is balanced while the second seesaw arm is separated from each of the stoppers 33 and 34.

Accordingly, when the centroid of the whole of the second seesaw arm 29 and the delay shutter 32 is positioned on the right side of the second arm shaft 31, the second seesaw arm 29 is rotated about the second arm shaft 31 due to the whole weight of the whole of the second seesaw arm and the delay shutter and is moved to the permission stop position shown in FIG. 9A where the second seesaw arm comes into contact with the second right stopper 33. Further, when the centroid of the whole of the second seesaw arm 29 and the delay shutter 32 is positioned on the left side of the second arm shaft 31, the second seesaw arm 29 is rotated due to the weight of the whole of the second seesaw arm and the delay shutter and is moved to the shielding stop position shown in FIG. 10A where the second seesaw arm comes into contact with the second left stopper 34.

In this case, when the delay shutter 32 is rotated together with the second seesaw arm 29 and the second seesaw arm 29 is moved to the permission stop position, the delay shutter is positioned at the detection permitting position and allows the detecting part SNa to be exposed to the intermediate transfer belt B as shown in FIG. 9A. When the second seesaw arm 29 is moved to the shielding stop position, the delay shutter is positioned at the shielding position and shields the detecting part SNa as shown in FIG. 10A.

The first and second seesaw arms 24 and 29 form a multi-stage transmission member 24+29 as an example of a transmission member of the third example.

The delay shutter 32 is supported by the second seesaw arm 29 of the multi-stage transmission member 24+29, and the first transmitted part 24*a* is formed at the first seesaw arm 24.

Further, the multi-stage transmission member 24+29 is adapted to be movable between a permission contact/separation part separating position shown in FIG. 9A and a shielding contact/separation part separating position shown in FIG. 10A. At the permission contact/separation part separating position, the first transmitted part 24*a* is separated from the upper contact/separation part 22*e* when the contact arm 22*b* is held at the entry position, and the second seesaw arm 29 is held at the permission stop position so that the delay shutter 32 is held at the detection permitting position. At the shielding contact/separation part separating position, the first transmitted part 24*a* is separated from the lower contact/separation part 22*f* when the contact arm 22*b* is held at the medium contact position, and the second seesaw arm 29 is held at the shielding stop position so that the delay shutter 32 is held at the shielding position.

(As for Interlock Between Sheet-Passing Contact Member and First and Second Seesaw Arms)

Here, the sheet-passing contact member 22, the first seesaw arm 24, and the second seesaw arm 29, are adapted as follows: when the recording sheet S does not pass through the pre-registration sheet detection area Q12', as shown in FIG. 9A, the contact arm 22*b* of the sheet-passing contact member 22 is held at the entry position, the first seesaw arm 24 is held at the visible image detecting unit-side stop position, and the second seesaw arm 29 is held at the permission stop position. The delay shutter 32 is held at the detection permitting position.

In this case, as shown in FIG. 9A, the first transmitted part 24*a* of the first seesaw arm 24 is separated from the upper contact/separation part 22*e* of the sheet-passing contact member 22, and the right transmitted part 29*d* of the second seesaw arm 29 is separated from the transmission contact/separation part 24*b* of the first seesaw arm 24.

When the recording sheet S enters the pre-registration sheet detection area Q12' and the contact arm 22*b* of the sheet-passing contact member 22 comes into contact with the front end of the recording sheet S in the conveying direction and is moved to the medium contact position from the entry position, the upper contact/separation part 22*e* of the sheet-passing contact member 22 comes into contact with the first transmitted part 24*a* of the first seesaw arm 24 held at the visible image detecting unit-side stop position as shown in FIG. 9B while the contact arm is moved to the medium contact position.

Meanwhile, while the recording sheet S having entered the pre-registration sheet detection area Q12' passes through the pre-registration sheet detection area Q12', the contact arm 22*b* of the sheet-passing contact member 22 comes into contact with the recording sheet S as shown in FIGS. 9C to 9F and 10 and is held at the medium contact position.

In FIG. 9C, when the first seesaw arm 24 is rotated by being pushed by the upper contact/separation part 22*e* from the visible image detecting unit-side stop position toward the conveying passage-side stop position, the centroid of the first seesaw arm 24 is moved from the left side of the first arm shaft 26 to the right side thereof.

In FIGS. 9C to 9D, the first seesaw arm 24 of which the centroid has been moved to the right side of the first arm shaft 26 is moved toward the conveying passage-side stop position by its own weight, and the first transmitted part 24*a* is separated from the upper contact/separation part 22*e* of the sheet-passing contact member 22 which is moved to the medium contact position and of which the rotation is stopped.

In FIG. 9D, while being moved to the conveying passage-side stop position, the transmission contact/separation part 24*b* of the first seesaw arm 24 comes into contact with the right transmitted part 29*d* of the second seesaw arm 29 that is held at the permission stop position.

In FIG. 9D, the second seesaw arm 29 is moved to the shielding stop position from the permission stop position by being pushed by the transmission contact/separation part 24*b* of the rotating first seesaw arm 24, so that the centroid of the whole of the second seesaw arm 29 and the delay shutter 32 is moved from the right side of the second arm shaft 31 to the left side thereof.

As shown in FIGS. 9E and 9F, the second seesaw arm 29 of the whole of the second seesaw arm 29 and the delay shutter 32, of which the centroid has been moved to the left side of the second arm shaft 31, is moved to the conveying passage-side stop position. Further, the right transmitted part 29*d* is separated from the transmission contact/separation part 24*b* of the first seesaw arm 24 of which the rotation is stopped, and is moved up to the shielding stop position by its own weight of the whole of the second seesaw arm 29 and the delay shutter 32.

Furthermore, the delay shutter 32 supported by the second seesaw arm 29, which is held at the shielding stop position, is held at the shielding position, so that the shielding of the detecting part SNa is kept.

Accordingly, until the rear end of the recording sheet S in the conveying direction passes through the pre-registration sheet detection area Q12', the contact arm 22*b* of the sheet-passing contact member 22 is held at the medium contact position and the first seesaw arm 24 is held at the conveying passage-side stop position as shown in FIGS. 9F and 10A. Further, the second seesaw arm 29 is held at the shielding stop position, and the delay shutter 32 is held at the shielding position.

In this case, as shown in FIGS. 9F and 10A, the first transmitted part 24*a* of the first seesaw arm 24 is separated from the lower contact/separation part 22*f* of the sheet-passing contact member 22, and the left transmitted part 29*c* of the second seesaw arm 29 is separated from the transmission contact/separation part 24*b* of the first seesaw arm 24.

When the rear end of the recording sheet S in the conveying direction passes through the pre-registration sheet detection area Q12' and the sheet-passing contact member 22 is separated from the rear end of the recording sheet S in the conveying direction as shown in FIGS. 10A and 10B, the contact arm 22*b* of the sheet-passing contact member 22 begins to be moved to the entry position from the medium contact position by its own weight.

In FIG. 10B, while the contact arm 22*b* of the sheet-passing contact member 22 is moved to the entry position, the lower contact/separation part 22*f* of the sheet-passing contact member 22 comes into contact with the first transmitted part 24*a* of the first seesaw arm 24 that is held at the conveying passage-side stop position.

Meanwhile, if the recording sheet S passing through the pre-registration sheet detection area Q12' is gone, the sheet-passing contact member 22 is held at the entry position as shown in FIGS. 10C to 10F.

In FIG. 10C, when the first seesaw arm 24 is rotated by being pushed by the lower contact/separation part 22*f* from the conveying passage-side stop position toward the visible image detecting unit-side stop position and the centroid of the first seesaw arm 24 is thus moved from the right side of the first arm shaft 26 to the left side thereof, the first seesaw arm is rotated toward the visible image detecting unit-side stop position by its own weight.

In FIGS. 10C to 10E, when the sheet-passing contact member is moved to the entry position so that the rotation of the sheet-passing contact member 22 is stopped, the first transmitted part 24*a* of the first seesaw arm 24 is separated from the lower contact/separation part 22*e* and moved toward the visible image detecting unit-side stop position by its own weight.

In FIG. 10D, while the first seesaw arm 24 is moved to the visible image detecting unit-side stop position, the transmission contact/separation part 24*b* comes into contact with the left transmitted part 29*c* of the second seesaw arm 29 that is held at the shielding stop position.

In FIG. 10D, the second seesaw arm 29, which is pushed by the transmission contact/separation part 24*b* of the first seesaw arm 24 that is being rotated, begins to be rotated from the shielding stop position toward the permission stop position.

In FIGS. 10D to 10F, if the centroid of the whole of the second seesaw arm 29 and the delay shutter 32 is moved from the left side of the second arm shaft 31 to the right side thereof by the rotation of the second seesaw arm 29, the second seesaw arm 29 begins to be rotated toward the visible image detecting unit-side stop position by its own weight.

The second seesaw arm 29 of the whole, of which the centroid has been moved to the left side of the second arm shaft 31, is moved to the visible image detecting unit-side stop position. The left transmitted part 29*c* is separated from the transmission contact/separation part 24*b* of the first seesaw arm 24 of which the rotation is stopped, and is moved toward the permission stop position by its own weight of the whole of the second seesaw arm 29 and the delay shutter 32.

Further, the state of the multi-stage transmission member returns to a state where the detecting part SNa is exposed to the intermediate transfer belt B as shown in FIG. 10F and the next recording sheet S does not pass yet as shown in FIG. 9A.

Accordingly, the multi-stage transmission member 24+32 is moved between the permission contact/separation part separating position and the shielding contact/separation part separating position by coming in contact with the upper or lower contact/separation part 22*e* or 22*f* of the sheet-passing contact member 22 while the contact arm 22*b* is moved between the entry position and the medium contact position. Further, the multi-stage transmission member makes the delay shutter 32 move between the detection permitting position and the shielding position while interlocking with the movement between the permission contact/separation part separating position and the shielding contact/separation part separating position.

(Operation of Third Example)

In the image forming apparatus U according to the third example that has the above-mentioned structure, the contact arm 22*b* of the sheet-passing contact member 22 comes into contact with and is separated from the recording sheet S that passes through the pre-registration sheet detection area Q12', and is moved between the entry position and the medium contact position. Further, the delay shutter 32 is moved between the detection permitting position and the shielding position while interlocking with the movement of the sheet-passing contact member 22 through the first and second seesaw arms 24 and 29 like in the first and second examples.

In this case, in the delay shutter opening/closing mechanism 21 of the third example, the movement of the first seesaw arm 24 starts at time intervals if the movement of the sheet-passing contact member 22 starts, and the movement of the first seesaw arm 24 is completed at time intervals if the movement of the sheet-passing contact member 22 is completed.

Further, the movement of the second seesaw arm 29 and the delay shutter 32 starts at time intervals if the movement of the first seesaw arm 24 starts, and the movement of the second seesaw arm 29 and the delay shutter 32 is completed at time intervals if the movement of the first seesaw arm 24 is completed.

That is, in the delay shutter opening/closing mechanism 21 of the third example, the start time and completion time of the movement of the sheet-passing contact member 22, that is, the opening/closing time of the delay shutter 32 is delayed from the movement time.

Here, in the image forming apparatus U according to the third example, the toner image Tn is formed on the intermediate transfer belt B in accordance with the time where the front end of the recording sheet S in the conveying direction reaches the secondary transfer area Q5, and the distance between the pre-registration sheet detection area Q12' and the secondary transfer area Q5 is set to be longer than the distance between the toner image detection area Q11 and the secondary transfer area Q5. Accordingly, the time where the toner image to be transferred to the recording sheet S passes through the toner image detection area Q11 is later than the time where the recording sheet S passes through the pre-registration sheet detection area Q12'.

Accordingly, in the structure where the movement of the contact arm 22*b* of the sheet-passing contact member 22 and the opening/closing of the shutter 32 are performed at the same time, the detecting part SNa is shielded by the shutter 32 before the front end of the toner image Tn in the conveying direction reaches the toner image detection area Q11. For this reason, there is a concern that the shutter 32 allows the detecting part SNa to be exposed before the rear end of the toner image Tn in the conveying direction passes through the toner image detection area Q11.

In contrast, in the third example, the opening/closing time of the shutter 32 is set to be later than the movement time of the contact arm 22*b* of the sheet-passing contact member 22 by each of the seesaw arms 24 and 29. Accordingly, since the detecting part SNa is shielded by the structure where difference between the opening/closing time of the shutter 32 and the passing time of the toner image Tn in the toner image detection area Q11 is suppressed, it may be possible to suppress the defacement of the detecting part SNa caused by the scattering of the toner in comparison with the structure where a time difference is generated.

(Modifications)

The examples of the invention have been described above in detail. However, the invention is not limited to the examples, and may have various modifications within the scope of the invention that is described in the appended claims. The modifications (H01) to (H011) of the invention will be exemplified below.

(H01) The printer U has been exemplified as an example of an image forming apparatus in each of the above-mentioned examples. However, the image forming apparatus is not limited to a printer, and the invention may be applied to a copy machine, a facsimile, or a complex machine having a plurality of functions thereof. Further, the image forming apparatus is not limited to an image forming apparatus that performs multicolor developing, and may be formed of a one-color, that is, so called monochrome image forming apparatus.

(H02) As for the toner image detecting sensor SN that detects the toner image held on the intermediate transfer belt B as an example of an image holding member, the structure, which shields the detecting part SNa of the toner image detecting sensor SN with the shielding part 2*b*, 12*b*, or 32, has been exemplified in each of the above-mentioned examples. The invention is not limited thereto. For example, an image forming apparatus, where the intermediate transfer belt B is omitted and toner images are directly transferred to the recording sheet S from the photoreceptors Py to Pk as an example of an image holding member, may be provided with a visible image detecting unit that detects the toner images held on the photoreceptors Py to Pk, and shield a detecting part of the visible image detecting unit with the shielding part 2*b*, 12*b*, or 32.

(H03) In each of the above-mentioned examples, it is preferable that the medium contact part 3*c*, 12*a*, or 22*b* be moved from the medium contact position to the entry position by its own weight. However, for example, the medium contact part 3*c*, 12*a*, or 22*b* may be moved from the medium contact position to the entry position by a coil spring as an example of a pushing member.

(H04) In each of the above-mentioned examples, the sheet detection area Q12 and the pre-registration sheet detection area Q12' have been set on the sheet conveying passage SH that extends in the vertical direction. However, the sheet detection area and the pre-registration sheet detection area are not limited thereto, and the sheet detection areas Q12 and Q12' may be set on the conveying passage that extends in the horizontal direction, the oblique direction, or the like.

(H05) In the first and second examples, it is preferable that the moving distances L1 and L1' of the recording sheet S between the secondary transfer area Q5 and the medium contact parts 3*c* and 12*a* corresponding to the entry position be set to be longer than the moving distance m1 of the toner image between the secondary transfer area Q5 and the primary transfer area Q4*k*, and the moving distances L2 and L2' of the recording sheet S between the secondary transfer area Q5 and the medium contact parts 3*c* and 12*a* corresponding to the medium contact position be set to be shorter than the moving distance m2 of the toner image between the secondary transfer area Q5 and the toner image detection area Q11. However, the invention is not limited thereto, and the length relationships between the moving distances m1 and m2 and the moving distances L1, L1', L2, and L2' may be set to arbitrary length relationships in accordance with the positional relationships between the image holding member and the visible image detecting unit.

(H06) The structure where the sheet contact part 12*a* and the shutter part 12*b* are rotated about the shaft 13 has been exemplified in the second example, but the invention is not limited thereto. For example, the medium contact part and the shielding part may be integrally formed and slide, that is, be slidably moved.

Further, the structure where the medium contact parts 3*c* and 22*b* are rotated about the shafts 3*a* and 23 and the shielding parts 2*b* and 32 are rotated about the shafts 2*a* and 31 has been exemplified in the first and third examples, but the invention is not limited thereto. For example, the medium contact parts 3*c* and 22*b* may come into contact with the recording sheet S and be slidably moved between the entry position and the medium contact position, and the shielding parts 2*b* and 32 may be rotated about the shafts 2*a* and 31 through the transmission members between the detection permitting position and the shielding position. Alternatively, in contrast, the medium contact parts 3*c* and 22*b* may come into contact with the recording sheet S and be rotated about the shafts 3*a* and 23 through the transmission members between the entry position and the medium contact position, and the shielding parts 2*b* and 32 may be slidably moved through the transmission members between the detection permitting position and the shielding position.

(H07) The structure where the first seesaw arm 24 is moved while being pushed by the sheet-passing contact member 22 and the second seesaw arm 29 is moved while being pushed by the first seesaw arm 24 has been exemplified in the third example. However, the first and second seesaw arms 24 and 29 may be moved by being pushed, that is, may be moved by impacts during contact.

(H08) The transmission member 24+29 has been formed of two members, that is, the first and second seesaw arms 24 and 29 in the third example, but the transmission member is not limited thereto. For example, the second seesaw arm 29 may be omitted and the transmission member may be formed of only one transmission member, that is, the first seesaw arm 24. Alternatively, the transmission member may be formed of three or more seesaw arms.

(H09) In each of the above-mentioned examples, it is preferable that the shielding parts 2*b*, 12*b*, and 32 be disposed between the toner image detecting sensor SN and the secondary transfer area Q5 at the detection permitting position that is set closer to the secondary transfer area Q5 than the shielding position. However, the invention is not limited thereto. For example, the shielding position may be set closer to the secondary transfer area Q5 than the detection permitting position, or the shielding part may not be disposed between the toner image detecting sensor SN and the secondary transfer area Q5 at the detection permitting position that is set closer to the secondary transfer area Q5 than the shielding position.

(H010) Each of the shielding parts 2*b*, 12*b*, and 32 has not been provided with a cleaning member in each of the above-mentioned examples. However, each of the shielding parts 2*b*, 12*b*, and 32 may be provided with a cleaning member, and may clean the detecting part SNa when the shielding parts 2*b*, 12*b*, and 32 are moved from the detection permitting position to the shielding position.

(H011) The structure where the sheet contact part 12*a* and the shutter part 12*b* are formed at the reciprocating member 12, that is, the structure where the sheet contact part 12*a* and the shutter part 12*b* are integrally formed has been exemplified in the second example, but the invention is not limited thereto. For example, a member including the sheet contact part 12*a* may be formed separately from a member including the shutter part 12*b*, and the members may be integrated during the installation and may be moved as the reciprocating member 12 as a single body.

Meanwhile, other than the structure exemplified in each of the above-mentioned examples, the medium contact parts 3*c*, 12*a*, and 22*b* and the shielding parts 2*b*, 12*b*, and 32 may be arbitrarily assembled or integrally formed according to the structure. For example, the structure where the second transmission member 29 is formed separately from the shielding part 32 has been exemplified in the third example, but the second transmission member may be formed integrally with the shielding part.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding member that holds a visible image formed by a developer;

a visible image detecting unit that includes a detecting part and detects the visible image, the detecting part being disposed so as to face the image holding member;

a shielding part that is supported so as to be movable between a shielding position where the shielding part enters between the detecting part and the image holding member and shields the detecting part, and a detection permitting position where the shielding part allows the detecting part to be exposed to the image holding member;

a conveying passage along which a medium is conveyed, the visible image held on the image holding member being transferred to the medium; and a medium contact part that is supported so as to be movable between an entry position where the medium contact part enters the conveying passage, and a medium contact position where the medium contact part comes into contact with the medium passing through the conveying passage and recedes from the entry position;

a transmission member that moves the shielding part to the shielding position from the detection permitting position while interlocking with the movement of the medium contact part that is moved to the medium contact position from the entry position, and moves the shielding part to the detection permitting position from the shielding position while interlocking with the movement of the medium contact part that is moved to the entry position from the medium contact position.

2. The image forming apparatus according to claim 1, further comprising:

a shielding member that includes the shielding part and is supported so as to be rotated about a shielding member shaft; and a medium contact member that includes the medium contact part and is supported so as to be rotated about a medium contact member shaft, wherein the transmission member of which one end is connected to the shielding member and the other end is connected to the medium contact member.

3. The image forming apparatus according to claim 1, further comprising:

a rotatable member that is supported so as to be rotated about a shaft, the rotatable member is formed integrally with the medium contact part at a side of conveying passage and formed integrally with the shielding part at a side of the visible image detecting unit.

4. The image forming apparatus according to claim 1, further comprising:

a transfer device that transfers the visible image to the medium in a transfer area, the visible image being held on the image holding member, the transfer area facing the image holding member, and the medium passing through the transfer area, wherein the visible image detecting unit includes the detecting part facing the image holding member in an image detection area, the image detection area being set upstream of the transfer area in a rotation direction of the image holding member, wherein the medium contact part is disposed in a medium detection area set upstream of the transfer area in a medium conveying direction along the conveying passage, wherein, at the entry position, the medium contact part comes into contact with a front end of the medium passing through the medium detection area in the medium conveying direction, the medium contact part is moved toward the medium contact position set downstream of the entry position in the medium conveying direction, and at the medium contact position, the medium contact part comes into contact with the medium passing through the medium detection area, and wherein a moving distance of the medium, which is conveyed along the conveying passage between the medium contact part and the transfer area at the entry position, is longer than a moving distance of the visible image, which is held on the image holding member, between the image detection area and the transfer area.

5. The image forming apparatus according to claim 1, further comprising:

a transfer device that transfers the visible image to the medium in a transfer area, the visible image being held on the image holding member, the transfer area facing the image holding member, and the medium passing through the transfer area, wherein the visible image detecting unit includes the detecting part facing the image holding member in an image detection area, the image detection area being set upstream of the transfer area in a rotation direction of the image holding member, wherein the medium contact part is disposed in a medium detection area set upstream of the transfer area in a medium conveying direction along the conveying passage, wherein, at the entry position, the medium contact part comes into contact with a front end of the medium passing through the medium detection area in the medium conveying direction, the medium contact part is moved toward the medium contact position set downstream of the entry position in the medium conveying direction, and at the medium contact position, the medium contact part comes into contact with the medium passing through the medium detection area, wherein a moving distance of the medium, which is conveyed along the conveying passage between the medium contact part and the transfer area at the medium contact position, is shorter than a moving distance of the visible image, which is held on the image holding member, between the image detection area and the transfer area.

6. The image forming apparatus according to claim 1, further comprising:

a medium contact member that includes the medium contact part and a medium-side contact/separation part, the medium-side contact/separation part coming into contact with and being separated from the transmission member, wherein, the transmission member supports the shielding part at one end, and the transmission member includes a transmission-side contact/separation part at the other end, the transmission-side contact/separation part coming into contact with and is separated from the medium-side contact/separation part, wherein the transmission member is supported so as to be movable between a permission contact/separation part separating position and a shielding contact/separation part separating position, the permission contact/separation part separating position indicates a position where the shielding part is held at the detection permitting position and the transmission-side contact/separation part is separated from the medium-side contact/separation part when the medium contact part is held at the entry position, and the shielding contact/separation part separating position indicates a position where the shielding part is held at the shielding position and the transmission-side contact/separation part is separated from the medium-side contact/separation part when the medium contact part is held at the medium contact position, and wherein the transmission member coming into contact with the medium-side contact/separation part while the medium contact part is moved between the entry position and the medium contact position, (i) is moved between the permission contact/separation part separating position and the shielding contact/separation part separating position, and (ii) moves the shielding part between the detection permitting position and the shielding position while interlocking with the movement between the permission contact/separation part separating position and the shielding contact/separation part separating position.

7. An image forming apparatus comprising:

an image holding member that holds a visible image formed by a developer;

a visible image detecting unit that includes a detecting part and detects the visible image, the detecting part being disposed so as to face the image holding member;

a shielding part that is supported so as to be movable between a shielding position where the shielding part enters between the detecting part and the image holding member and shields the detecting part, and a detection permitting position where the shielding part allows the detecting part to be exposed to the image holding member;

a conveying passage along which a medium is conveyed, the visible image held on the image holding member being transferred to the medium;

a medium contact part that is supported so as to be movable between an entry position where the medium contact part enters the conveying passage, and a medium contact position where the medium contact part comes into contact with the medium passing through the conveying passage and recedes from the entry position; and a transfer device that transfers the visible image to the medium in a transfer area, the visible image being held on the image holding member, the transfer area facing the image holding member, and the medium passing through the transfer area, wherein the shielding part is moved to the shielding position from the detection permitting position while interlocking with the movement of the medium contact part that is moved to the medium contact position from the entry position, and the shielding part is moved to the detection permitting position from the shielding position while interlocking with the movement of the medium contact part that is moved to the entry position from the medium contact position, wherein the shielding part is moved between the shielding position and the detection permitting position, which is set closer to the transfer area than the shielding position, and is disposed between the visible image detecting unit and transfer area at the detection permitting position.

* * * * *